US006955542B2

(12) United States Patent
Roncalez et al.

(10) Patent No.: US 6,955,542 B2
(45) Date of Patent: Oct. 18, 2005

(54) SYSTEM FOR MONITORING REPETITIVE MOVEMENT

(75) Inventors: Pascal Roncalez, Bellevue, WA (US); Stephane Gentil, Le Havre (FR); Jay Petersen, Seattle, WA (US); Joel D. Schlekewey, Seattle, WA (US); Michael A. Wood, Bothell, WA (US)

(73) Assignee: Aquatech Fitness Corp., Bellevue, WA (US)

( * ) Notice: Subject to any disclaimer, the term of this patent is extended or adjusted under 35 U.S.C. 154(b) by 35 days.

(21) Appl. No.: 10/056,304

(22) Filed: Jan. 23, 2002

(65) Prior Publication Data

US 2003/0138763 A1 Jul. 24, 2003

(51) Int. Cl.[7] ..... A63B 69/10; A63B 69/12

(52) U.S. Cl. ..... 434/254; 434/247; 434/258

(58) Field of Search ..... 434/254, 118, 434/250; 472/13, 14, 128, 133; 482/55, 111; 440/113; 441/55–64

(56) References Cited

U.S. PATENT DOCUMENTS

| | | | | | |
|---|---|---|---|---|---|
| 4,526,473 | A | | 7/1985 | Zahn, III | 368/10 |
| 4,654,010 | A | | 3/1987 | Havriluk | 434/254 |
| 4,776,045 | A | | 10/1988 | Mysliwiec et al. | 2/426 |
| 4,869,575 | A | | 9/1989 | Kubik | 350/174 |
| 4,915,487 | A | | 4/1990 | Riddell, III et al. | 350/174 |
| 5,071,417 | A | | 12/1991 | Sinofsky | 606/8 |
| 5,258,785 | A | | 11/1993 | Dawkins, Jr. | 351/43 |
| 5,343,313 | A | | 8/1994 | Fergason | 359/83 |
| 5,391,080 | A | * | 2/1995 | Bernacki et al. | 434/254 |
| 5,402,188 | A | | 3/1995 | Wayne | 351/43 |
| 5,685,722 | A | | 11/1997 | Taba | 434/254 |
| 5,685,723 | A | | 11/1997 | Ladin et al. | |
| 5,864,518 | A | * | 1/1999 | Geiser | 368/10 |
| 5,921,890 | A | * | 7/1999 | Miley | 482/3 |
| 6,012,812 | A | | 1/2000 | Rickards | 351/158 |
| 6,033,228 | A | | 3/2000 | Ladin | 434/254 |
| 6,042,490 | A | | 3/2000 | Lenhart | 473/415 |
| 6,066,075 | A | | 5/2000 | Poulton | 482/8 |
| 6,085,428 | A | | 7/2000 | Casby et al. | 33/286 |
| 6,086,379 | A | | 7/2000 | Pendergast et al. | |
| 6,251,048 | B1 | * | 6/2001 | Kaufman | 482/8 |
| 6,305,221 | B1 | * | 10/2001 | Hutchings | 73/488 |
| 6,463,385 | B1 | | 10/2002 | Fry | |

* cited by examiner

*Primary Examiner*—Chanda L. Harris
*Assistant Examiner*—John Sotomayor
(74) *Attorney, Agent, or Firm*—Seed IP Law Group PLLC

(57) ABSTRACT

A system for detecting, tracking, displaying and identifying repetitive movement, including a sensor configured to sense movement, and in particular static acceleration, along at least a first horizontal axis, and ideally about a second horizontal axis, with respect to a vertical axis and a processor to generate output signals therefrom for audible and visual display of information that can include movement identification, movement patterns, and to further include elapsed time, start and stop times, breathing patterns, and variations thereof from a reference.

25 Claims, 38 Drawing Sheets

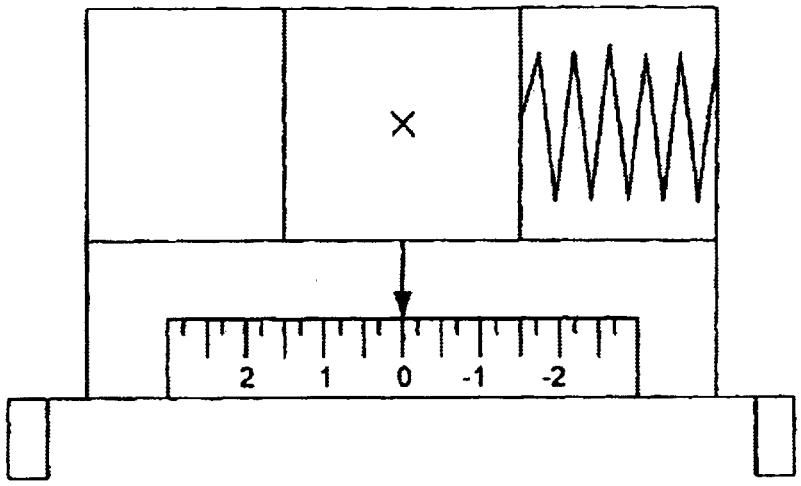
*FIG. 3* The accelerometer is not submitted to elongation or compression forces.
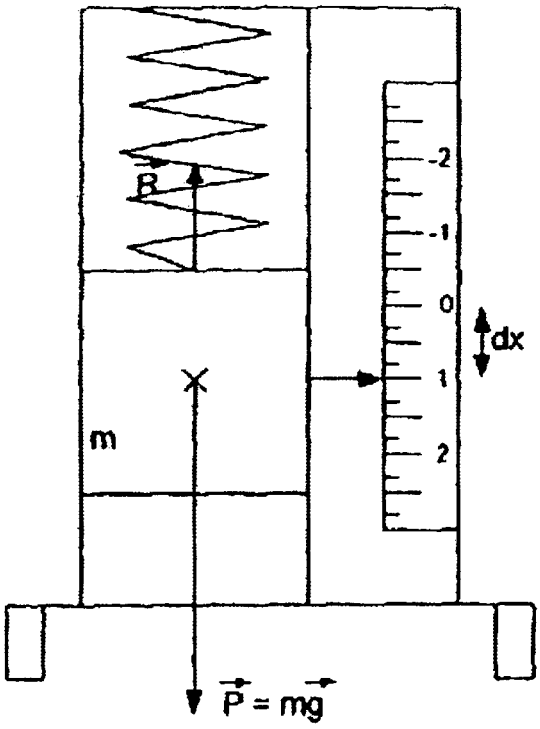
*FIG. 4* The accelerometer is submitted to the force of gravity (static acceleration)
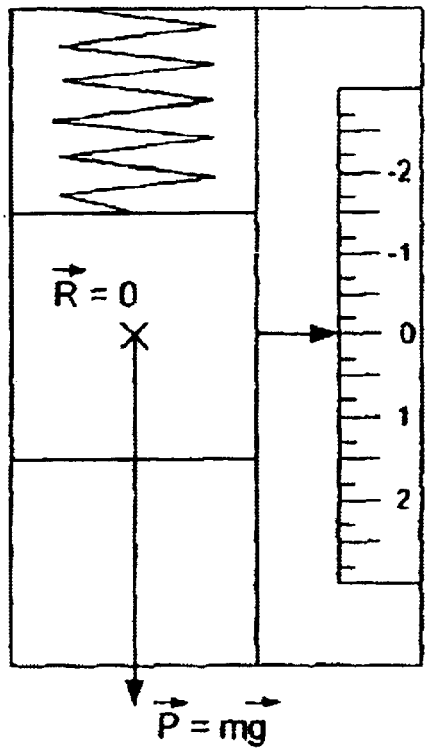
*FIG. 5* System in free fall

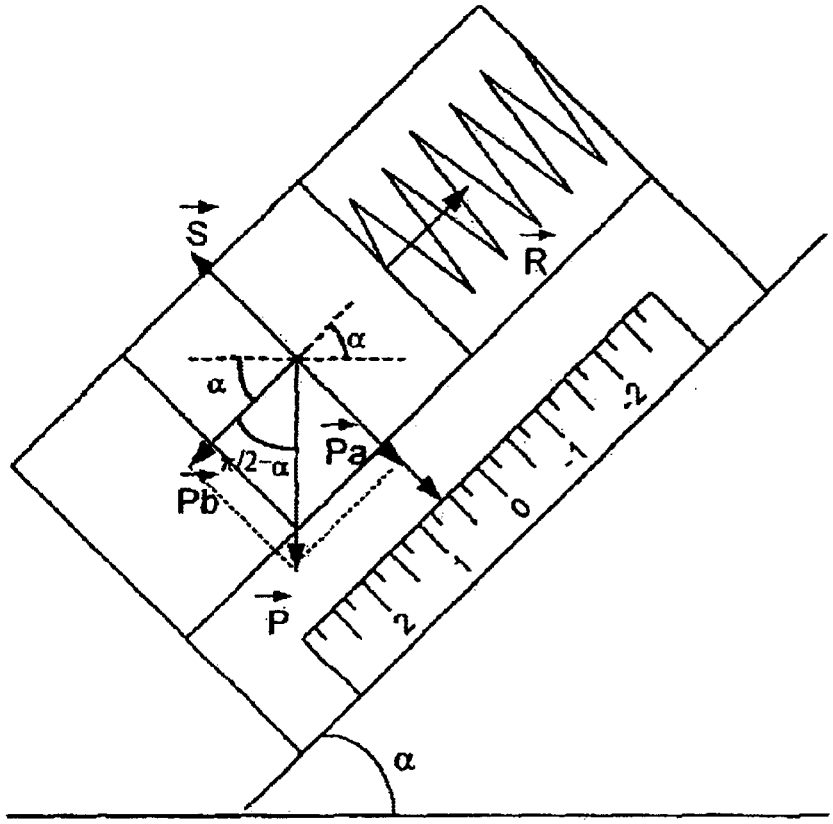
*FIG. 6* Accelerometer laying at an angle
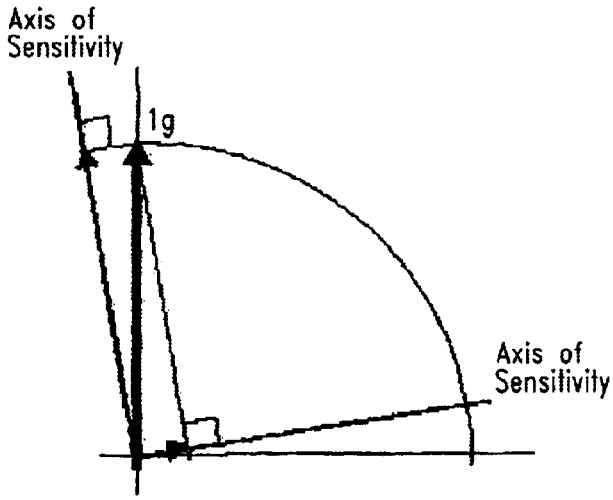
| Angle α | Sinus α | Δα |
|---|---|---|
| 0 | 0.00 | |
| 10 | 0.17 | 0.17 |
| 20 | 0.34 | 0.17 |
| 30 | 0.50 | 0.16 |
| 40 | 0.64 | 0.14 |
| 50 | 0.77 | 0.13 |
| 60 | 0.87 | 0.10 |
| 70 | 0.94 | 0.07 |
| 80 | 0.98 | 0.04 |
| 90 | 1 | 0.02 |
*FIG. 7* Axes of sensitivity

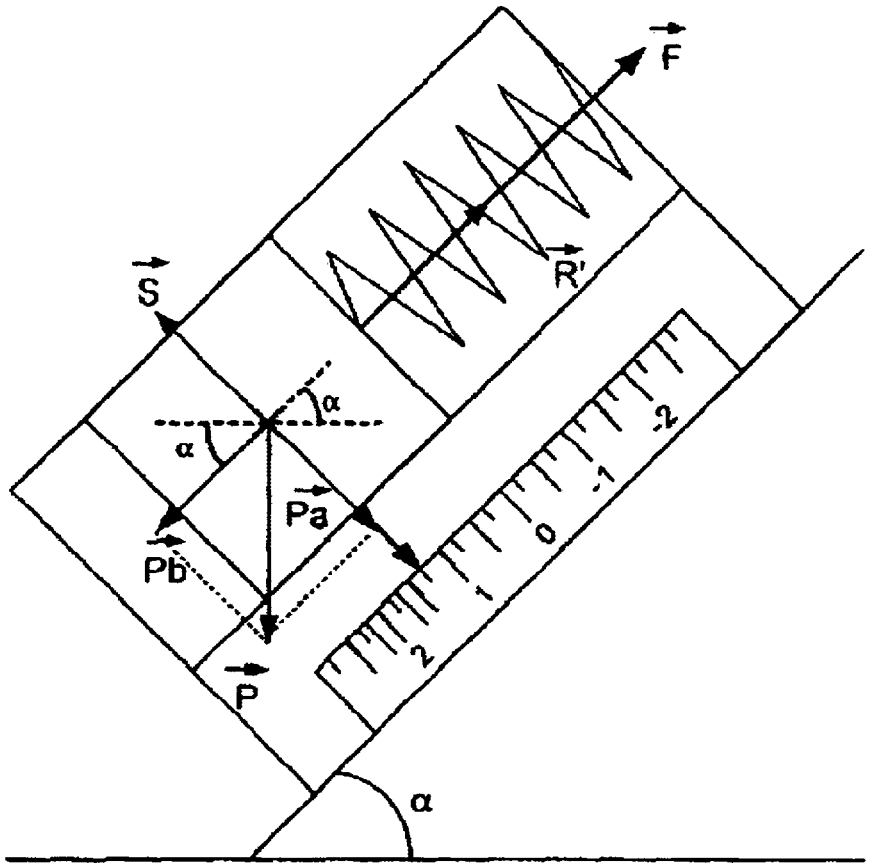
*FIG. 8* Dynamic acceleration applied to the system

*FIG. 19* Example of digital samples captured by the accelerometer at 50Hz.

*FIG. 20* Illustration of an interval of confidence representing 100ms. Sample 8 is a peak centered within an interval of 100ms

*FIG. 21* 1st digital sample is compared to its 2 closest neighbors to the right. (no data available to the left).

*FIG. 22* 2nd digital sample is compared to its 2 closest neighbors to the right and unique neighbor to the left.

*FIG. 23* 3rd digital sample is compared to its 2 closest neighbors to the right and left (general situation).

*FIG. 24* 7th digital sample is a peak.

FIG. 25 Last sample is compared to its 2 closest neighbors to the left. A total of three peaks were detected by the system.

*FIG. 26* Digital sample 2 is compared to its immediate neighbors to the right and to the left.

FIG. 41 Three peaks

Butterfly (stroke frequency 0.7 Hz). Maxima and minima are displayed.

Butterfly. Maxima and minima are displayed.

Backstroke. Maxima and minima are displayed.

Backstroke (stroke frequency 0.4Hz). Maxima and minima are displayed.

SYSTEM FOR MONITORING REPETITIVE MOVEMENT

BACKGROUND OF THE INVENTION

1. Field of the Invention

The present invention pertains to a system for detecting, tracking, displaying, and identifying repetitive movement of the human body, and more particularly, to a method and apparatus for monitoring human performance, including identification of movements, displaying variation in movement patterns, and detecting breathing patterns.

2. Description of the Related Art

Numerous methodologies and related devices exist for tracking movement of the human body, especially in the context of sporting activities, with the goals of improving performance and reducing injuries. One technique uses an accelerometer mounted on the body to detect movement by sensing acceleration and deceleration of the body.

There are two components of acceleration, typically identified as "static acceleration" and "dynamic acceleration." Static acceleration is prolonged acceleration, usually in one direction, such as the acceleration from gravity; whereas dynamic acceleration is created by rapid variations in velocity, such as caused by vibration and shock. Accelerometers will always detect both static and dynamic acceleration. In the absence of any motion, an accelerometer will always detect a static acceleration, which is the acceleration from gravity. Depending on the conditions under which an accelerometer is used, one of these two components of acceleration will prevail. The static acceleration will be generated from a change in position of the accelerometer with respect to a vertical axis used as a reference. For example, in the case of a swimmer, the motion of the body (rotation of the torso in crawl and backstroke and tilting of the torso in breaststroke and butterfly) will create a static acceleration that is much larger than the dynamic acceleration along the axis of motion resulting from the arm pull. On the other hand, an accelerometer used to measure acceleration and deceleration of a vehicle on a flat, straight road will generally only detect the dynamic acceleration (or deceleration). There will be no static acceleration relative to a vertical axis used as a reference because the position of the vehicle with respect to the vertical axis is unchanged.

One example of an accelerometer used in detecting human movement is described in U.S. Pat. No. 5,685,722 issued to Taba for electronic timing swimmer's goggles. Taba describes a three-axis accelerometer that is supposed to detect absolute variations in dynamic acceleration. The accelerometer is attached to the swimmer's goggles in a position to detect the swimmer's movement along an axis that is parallel to the direction of travel. Using a linear regression analysis method, Taba purports to count the swimmer's laps by determining when the swimmer starts, stops, and performs a turn. One disadvantage of this approach is the limited information it provides. Another disadvantage is poor performance due to the weak signals generated from the accelerometer because monitoring dynamic acceleration along the axis of motion produces very weak signals that tend to be lost or corrupted.

More particularly, Taba asserts that his device can detect the motion of a swimmer along the axis of motion from the dynamic acceleration. This would be true on a subject that moves without creating any static acceleration. An example would be a car or train on a flat, straight path. Because the body of a swimmer in Taba's application is constantly moving at any angle with respect to the vertical axis, a large static acceleration signal is generated that is superimposed on the weak dynamic acceleration signal. To remove this static component, it is necessary to have a fixed reference and have knowledge of the position of the swimmer with respect to the vertical axis at all times in order to subtract the static component from the global signal received by the sensor. Having the sensor attached to the swimmer as Taba teaches does not enable discrimination between the signal amplitude resulting from a change of angle with respect to the vertical axis and signal amplitude resulting from dynamic acceleration. Thus, the three-axis accelerometer as taught by Taba fails to get the swimmer's position from a fixed reference at all times, and when this condition is not met, the motion of the swimmer along the axis of motion cannot be known.

In addition, Taba teaches taking all the points of a received signal over one period and using a linear regression analysis method to characterize these points by two data defining a linear equation (m for slope and b for the linear equation $y=m*x+b$). Taba purports to repeat this process for a subsequent period and then compare the values of m and b, declaring the periods to be the same when these values are the same. However, Taba fails to teach how periodicity is determined. Without this fundamental teaching, Taba's invention cannot be practiced. In addition, Taba ignores the rupture of periodicity that occurs during starts and turn. Without detecting these ruptures and taking them into account, including extracting them mathematically, which Taba does not disclose, it is not possible to provide accurate and useful data.

Hence, there is a need for a device that produces valid and reliable information regarding continuous repetitive movement, including not just starting, stopping, and turning, but information regarding the type of movement, changes or variation in movement patterns, and other performance parameters, such as breathing patterns.

BRIEF SUMMARY OF THE INVENTION

The disclosed and claimed embodiments of the invention are directed to a system for monitoring repetitive movement, and which can include the detection of breathing patterns, starts, stops, and turning movements, such as course reversals. In one embodiment, a device is provided for determining information about repetitive movement, ideally about repetitive movement of a human body. The device includes a sensor assembly mounted to the human body comprising at least one acceleration sensor generating at least one acceleration signal; and a processor coupled to the sensor assembly and configured to determine at least one from among movement identification, movement pattern, and breathing pattern.

In accordance with another embodiment of the invention, a device is provided for determining and providing information about the repetitive movement of a swimmer's body, the device including a sensor comprising first and second accelerometers configured to generate first and second signals, and a processing circuit configured to receive the first and second signals and to provide real-time, continuous signals of the swimmer's stroke pattern. Ideally, the system is also configured to provide real-time, continuous signals identifying the swimmer's breathing pattern, and in addition the swimmer's kicking pattern. Preferably, the processor also provides an identification of the swimmer's stroke.

In accordance with another aspect of the foregoing embodiment, a display device is provided for displaying a real-time, continuous signal of the swimmer's stroke pattern, and alternatively of the swimmer's breathing pattern, and in a further alternative of the swimmer's stroke identification, stroke pattern, kick identification, kick pattern, and breathing pattern. The information may also be provided audibly, such as through an earpiece or a speaker.

In accordance with another embodiment of the invention, a device for monitoring repetitive movement of a human body is provided. The device includes a sensor apparatus configured to be mounted to the human body and to generate signals corresponding to acceleration of the human body about a first axis and about a second axis, respectively; and a processor configured to receive the signals and to generate therefrom at least one movement signal corresponding to a movement pattern of the human body. In one embodiment, the first and second axes are orthogonal to each other and lie within a horizontal plane, and orientation with respect to a vertical axis is analyzed. Ideally, the processor is configured to generate a plurality of signals corresponding to one or more of movement identification, movement count, movement pattern, of a selected area of the human body, as well as the breathing pattern.

In accordance with a further embodiment of the invention, a method is provided for monitoring repetitive movement of a human body, the method including mounting first and second accelerometers to the human body, the first accelerometer mounted to detect movement about a first axis that is parallel to the direction of movement of the human body, the second accelerometer mounted to detect movement about a second axis that is perpendicular to the first axis, and to detect acceleration therefrom with respect to a vertical axis; receiving signals from the first and second accelerometers in response to movement of the human body about the first and second axes with respect to a vertical axis; and processing the signals to determine the identification of the movement of the human body about the first and second axes and the changes in the movement over time.

BRIEF DESCRIPTION OF THE SEVERAL VIEWS OF THE DRAWINGS

The features and advantages of the disclosed and claimed embodiments of the invention will be more readily appreciated as the same become better understood from the detailed description when taken in conjunction with the following drawings, wherein:

FIGS. 3–8 are diagrams illustrating the measurement of static and dynamic acceleration under various conditions and orientations;

DETAILED DESCRIPTION OF THE INVENTION

A representative embodiment of the invention will now be described as used by an athlete in the context of swimming. However, it is to be understood that the present invention will have application to other activities involving continuous repetitive movement, such as running, walking, cycling, rowing, and the like. It will also have application to the physical re-education of injured parts of the body, such as arms and legs, as well as to "virtual coaching" where the quantitative data can be analyzed and coaching feedback provided in real time, including over the Internet and the like.

Figure 1A:
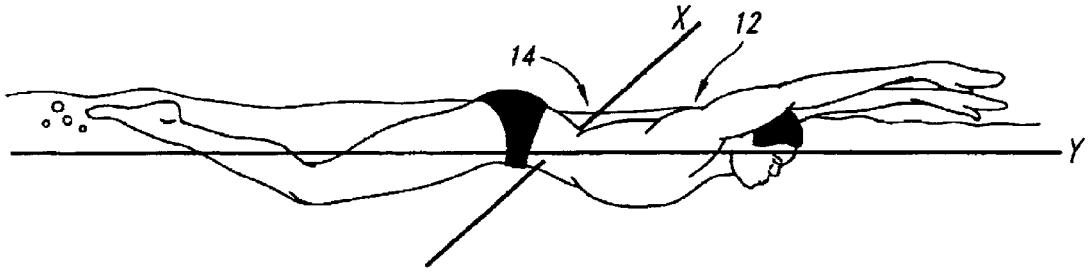
FIGS. 1A–1C are side views of a swimmer performing a butterfly.
Figure 1B:
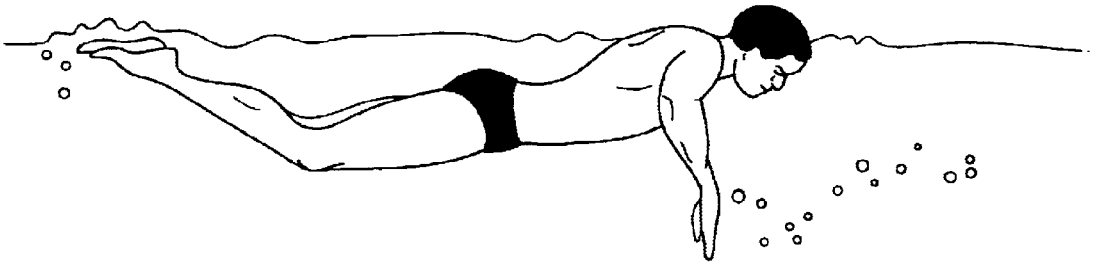
Figure 1C:
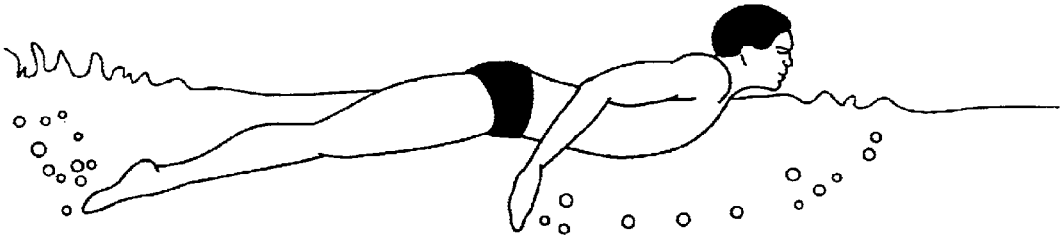
Figure 2A:
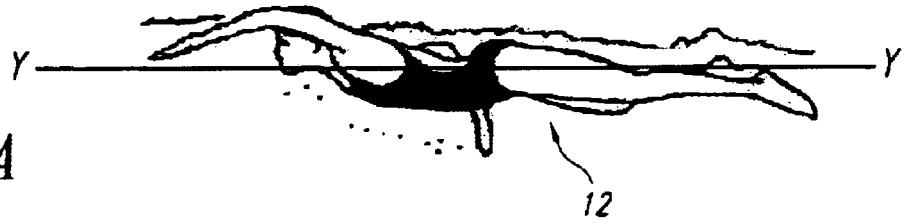
FIGS. 2A–2E are side views of a swimmer performing a crawl stroke.
Figure 2B:
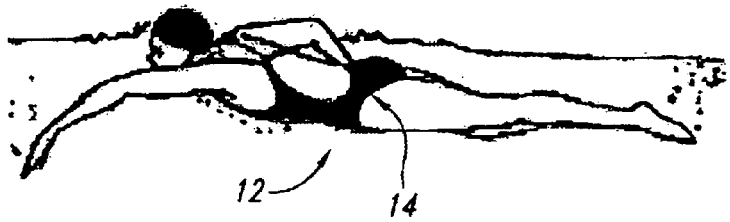
Figure 2C:
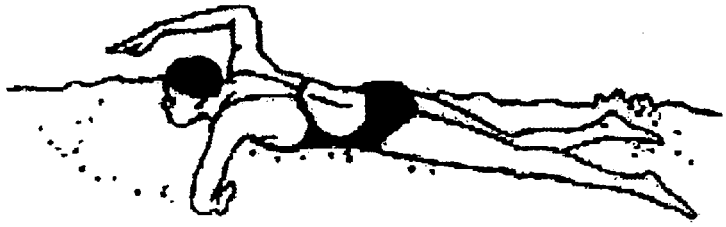
Figure 2D:
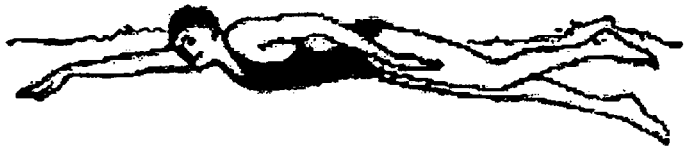
Figure 2E:
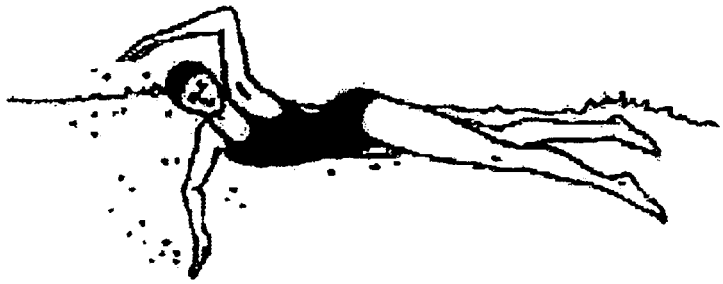
Figure 2F:
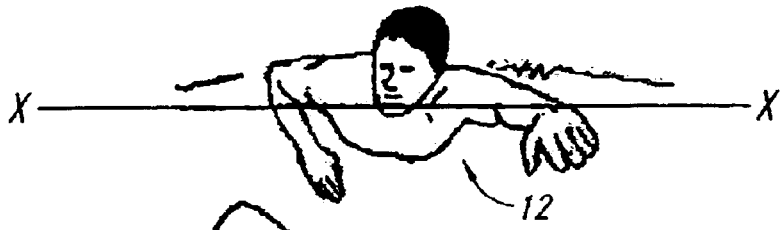
FIGS. 2F–2J are corresponding front views of a swimmer performing the crawl stroke.
Figure 2G:
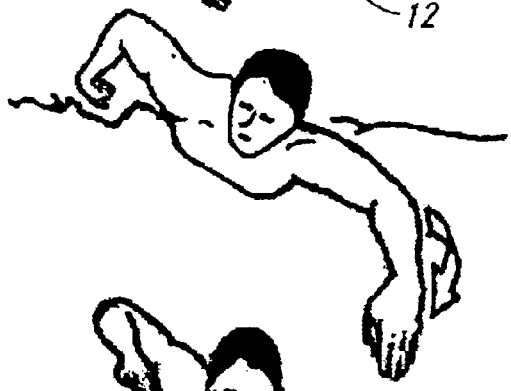
Figure 2H:
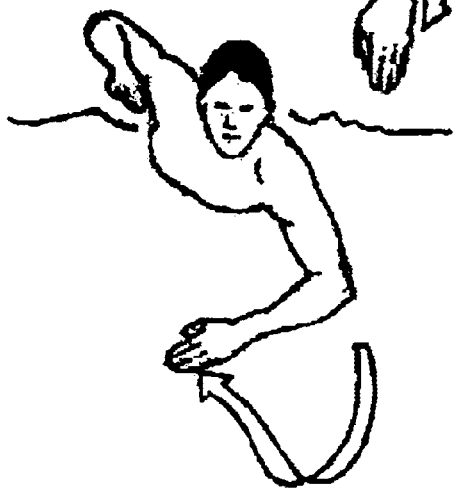
Figure 2I:
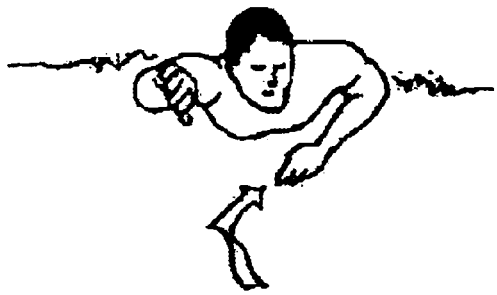
Figure 2J:
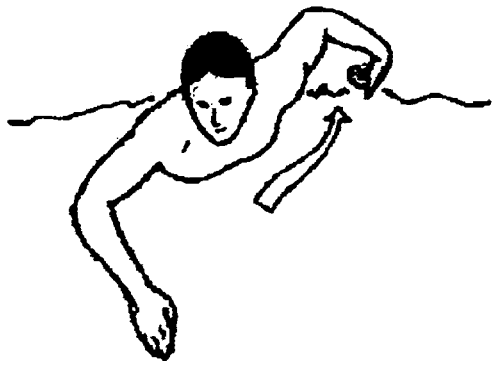

While the use of accelerometers to detect acceleration of the swimmer's body in a direction parallel to the direction of travel may be sufficient for determining starting and stopping times, the signals generated therefrom tend to be non-specific for characteristics of stroke, kick, and breathing. Because human skeletal components cooperate by hinged movement about rotational axes, their motion tends to be rotational instead of linear. Referring to FIGS. 1A through 1C, shown therein is the rotational movement of a swimmer's torso 12 about a transverse axis X at the swimmer's waist 14 during a butterfly stroke. Similarly, shown in FIGS. 2A–2J is the rotational movement of the swimmer's torso 12 about a longitudinal axis Y In crawl and backstroke, motion of the swimmer is mostly characterized by a rotation of the torso about the longitudinal axis Y. In breaststroke and butterfly, the motion of the swimmer's torso is mostly characterized by a tilt (up/down movement), referred to herein as "pitch" about the transverse axis X.

The disclosed embodiments of the invention rely primarily on detecting and measuring static acceleration. In order to understand the principles of operation of the present invention, it is necessary to review the function of accelerometers in general.

All accelerometers can be modeled by a spring attached to a mass. When the spring is not subjected to any elongation or compression forces, the center of gravity of the mass attached to it defines a reference or zero scale. This is illustrated in FIG. 3, where the system is laying on a horizontal plane (The arrow indicates a pointer to a graduated scale and not a vector).

FIG. 4 shows the same system on a horizontal plane, but rotated 90 degrees counterclockwise in the front view so that the left side is now in contact with the horizontal surface. In this situation, the suspended mass creates an elongation (dx) of the spring, proportional to the force of gravity. Since the system is idle, there is no other acceleration force than gravity, and the relation P−R=0 exists, with P the downward force exercised on the mass m (P=m*g, m the mass and g the force of gravity), and the reaction R (minus sign indicates a force of opposite direction to P) resulting from the elongated spring. R=K*dx, with K a constant characterizing the elasticity of the spring.

Therefore, proportionality between the elongation (dx) of the spring and the force of gravity (g) is established by the relation m*g=K*dx. The elongation of the spring caused by the force of gravity is also called the static acceleration.

From this explanation, it is important to note that accelerometers measure and report the amplitude of the force that is modeled by the elongations of the spring. In the particular condition of FIG. 4, the accelerometer provides a direct measure of the force of gravity (static acceleration).

Free Fall

Another situation is the free fall of the whole system along a vertical axis (see FIG. 5). Under these conditions, the only force F applied to the system is its own weight P. The dynamics equation links the force F to the acceleration a by the relation: F=m*a. On the other hand, p=m*g. Since F=P in the case of a free fall of the entire system, we can write a=g and demonstrate at the same time that the spring is not submitted to any elongation and that the acceleration "a" is independent of the mass "m" of the system.

Accelerometer Tilted at an Angle $\alpha$ from the Horizontal Plane

A more general situation is the case of the system tilted at an angle $\alpha$ from the horizontal axis (FIG. 6). Since the system is idle, the sum of all forces applied to the mass m equal zero: P+R+S=0, with P the force resulting from the weight of the system, R the reaction of the elongated spring, and S the force exerted by the plane supporting the mass m and oriented at an angle $\alpha$ from the horizontal axis. P can be represented by its components Pa and Pb as indicated in FIG. 6. Pa compensates for the force S, and therefore: Pa+S=0.

Pb is related to P by $\cos(\pi/2-\alpha)$=Pb/P. This relation can also be written Pb=P*sin $\alpha$. Since the sum of all forces applied to the mass m equal zero and Pa+S=0, we get Pb+R=0 or R=P*sin $\alpha$ (R and Pb have opposite signs). Since R=K*dx, we show that the elongation of the spring is proportional to sin $\alpha$.

In conclusion, when an accelerometer is standing at an angle from the horizontal, it measures a value of the static acceleration proportional to the sine of this angle.

Note that the accelerometer is most sensitive to tilt when its sensitive axes are perpendicular to the force of gravity, i.e., parallel to the earth's surface. FIG. 7 shows that the change in projection of a 1 g gravity-induced acceleration vector on the axis of sensitivity of the accelerometer will be more significant if the axis is tilted 10 degrees from the horizontal than if it is tilted by the same amount from the vertical.

Accelerometer Receiving a Dynamic Acceleration Along an Angle $\alpha$ from the Horizontal Plane If a dynamic acceleration "a" is applied to the mass m along the slope, it creates a force F related to the acceleration by the relation F=m*a, and the system is moving upwards (see FIG. 8). The total elongation of the spring is now dy and has increased by a value dx' with: dy=dx+dx'.

From the law of dynamics, the vector equation is: F=P+S+R', with F=m*a, P=Pa+Pb, and R'=K*dy.

Therefore: m*a=Pa+Pb+S+(K*dy). Since S=Pa and S and Pa are two vectors of opposite sign (see FIG. 8), S+Pa=0. In addition, K*dy=K*dx+K*dx'. When the system is not in motion (i.e. not subject to the acceleration a, see FIG. 6), then Pb=K*dx and K*dx and Pb are two vectors of opposite sign. Therefore, the following equation can be written: m*a=K*dx'. It has been shown that the incremental elongation of the spring dx' is directly proportional to the dynamic acceleration a.

However, the direct measure of the elongation provided by the accelerometer is dy. This value represents the sum of the elongation dx caused by the static acceleration due to gravity and the elongation dx' caused by the dynamic acceleration dx' due to movement.

In applying these principles to the present invention, and more particularly in the context of swimming, it has been shown above that an accelerometer will be most sensitive to tilt when its sensitive axes are perpendicular to the force of gravity, i.e., in a horizontal plane. Therefore, the device is mounted as much as possible in a horizontal plane, such as on the back of the swimmer or around the swimmer's head.

The amplitude of the dynamic acceleration resulting from the traction of the arms while swimming is far less than the amplitude of the static acceleration resulting from the motion of swimmer's body in the water. Because the motion of the body is caused by the arm stroke and breathing, the signals resulting from the static acceleration provide direct information of the stroke count and breathing pattern. The periodicity of the signal results directly from the periodicity of the arm stroke. In addition, since the position of the body changes dramatically when a turn is performed, a huge variation of the amplitude and a rupture of periodicity of the signal are observed.

The amplitude of the signal acquired by the accelerometer is the sum of the large amplitude of the static acceleration and the significantly smaller amplitude of the dynamic acceleration. This last component cannot be easily extracted from the signal, as it would require the knowledge of the variations of position of the accelerometer with the swimmer's body (angle $\alpha$) at any time in order to subtract the static component of the acceleration.

Figure 9:
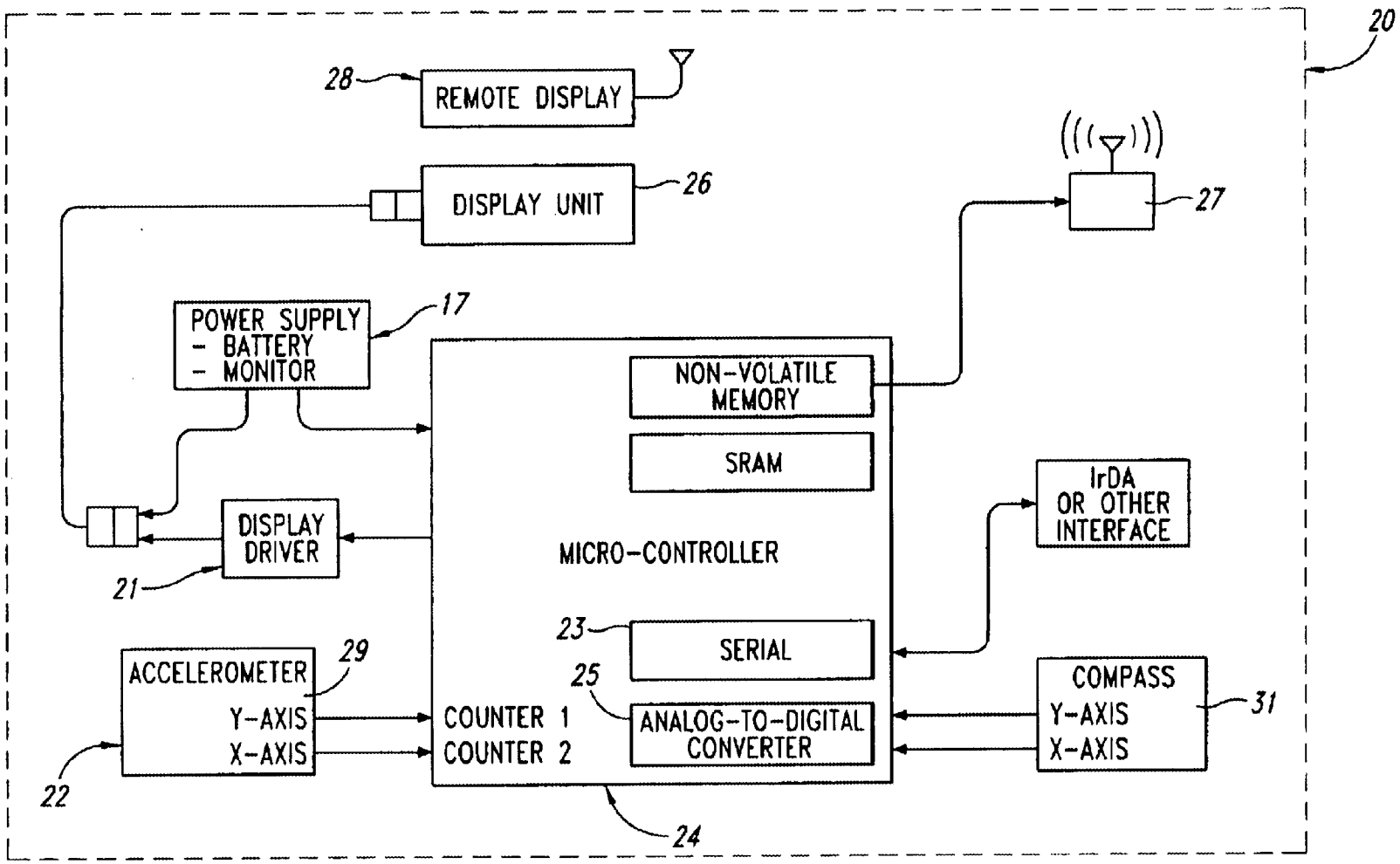
FIG. 9 is a block diagram of the components of a system formed in accordance with one embodiment of the invention.

Referring next to FIG. 9, shown therein is a block diagram of one embodiment of a system 20 formed in accordance with the present invention. This is a general overview of the system 20, which includes a sensor assembly 22 communicating with a processor 24. The communication may be by hard wire or via wireless transmission. The processor 24 in turn communicates with a display unit 26 configured to provide a display to the user.

The sensor assembly 22, the processor 24, and the display device 26 may be formed as a single unit, which would include the power supply 17 and display driver 21, or the sensor assembly 22 and the processor 24 may be formed in a single integrated chip along with driving circuitry for the display device 26. Such a chip may be an application specific integrated circuit (ASIC). Discrete components may be employed at separate locations. For example, the sensor assembly 22 may be mounted to the user's torso and the processor 24 and display unit 26, which would include the power supply 17 and display driver 21, may be mounted to the user's equipment as a separate unit, such as on goggles or a helmet, with communication performed via radio frequency (RF) transmission or via wire.

FIG. 9 also shows another embodiment wherein the processor communicates with a transmitter 27 to send signals to a remote system 28, which can be used by coaches for monitoring and analyzing performance. The display 26 viewed by the user may be a visual display, such as a heads-up display (HUD), or it may consist of an audible sound presented to the user through a speaker mounted in the helmet or an earpiece placed in the user's ear, or a combination of the visual display and audible sound may be provided to the user. A computer having additional signal processing capabilities can be used to communicate in real time with the swimmer, and on a remote computer additional analysis tools can be used to provide a finer analysis of the swimmer's performance to observers in real time or at a later time.

An electromagnetic compass 31 is shown in the block diagram as an optional component of the sensor assembly 22. The compass 31 will allow open water swimmers to maintain their heading while swimming. The benefit is that swimmers will not need to interrupt their swim or lift their head to assess their position and regularly correct their direction. A similar compass sensor as the one found in cars to indicates the heading while driving (N. NE, E, SE, S, SW, W, NW) can be used in this embodiment of the invention.

The device is initialized and calibrated by having the swimmer face the target (finish line at the opposite end of a lake for example) while wearing the goggles and before starting the swim, and to press a button in order to record the direction. While swimming, the athlete will see a cursor marking the set direction (reference) and a second one showing his/her position relative to the reference. Therefore, the swimmer will be able to monitor the relative position of both cursors (the reference cursor being fixed and the second one showing any drift) and correct any change of course immediately.

In a preferred embodiment, the sensor assembly 22 comprises a two-axis accelerometer 29 configured to sense acceleration about a first axis "Y" that is parallel to the direction of travel and about a second axis "X" that is perpendicular to the first axis. Thus, as the body tilts along the Y-axis, the torso rotates about the X-axis at the hips or waist, generating a static acceleration signal on the Y-axis. Similarly, as the user's body rolls or twists, the body rotates about the Y-axis, with the head, shoulders, and hips moving accordingly, generating a static acceleration signal on the X-axis.

As will be appreciated from the foregoing, the dynamic acceleration along the path of travel, which is parallel to the Y-axis, is not intended or necessary to be sensed. The static acceleration resulting from the change in the position of the accelerometer with respect to the vertical axis, produced by the rotational movement of the swimmer about the Y and X axes, is captured by the sensor assembly 22, which generates first and second acceleration signals.

The sensor assembly 22 may be formed of first and second accelerometers, or a two-axis accelerometer may be employed. Such devices are readily commercially available and will not be described in detail herein. Briefly, one such accelerometer is an ADXL202E sensor available from Analog Devices of Norwood, Mass. The accelerometer may be of the capacitive type, which is a superior detector of static acceleration. The accelerometer may be an integrated micro electromechanical system (MEMS), which is small and of a light weight.

The signals generated from the swimming action are immediately converted from continuous analog form into digital form by an A/D converter 25, and are received at the processor 24, where signals are generated in response thereto for output to the display unit 26.

The digital signals comprise digital samples that carry time values and amplitude values. The processor is configured to "process" the digital data to extract desired information, such as analysis of periodicity and peak detection for stroke count, stroke identification and breathing pattern, rupture of periodicity and change of waveform for starts, lap count, and stops.

A software processing application is configured to extract this information and communicate it to the swimmer, coaches, and spectators via the display module. In one embodiment, the peak values correspond to stroke count, with one peak per stroke, and peaks of higher amplitude in the crawl and butterfly stroke correspond to the time the swimmer was breathing. Each peak in the breaststroke will correspond to a breathing action, because of the fundamental nature of the stroke itself. Ruptures of periodicity are marked by starts and turns, where the dynamic acceleration is the prevailing signal.

The output may be displayed graphically, which can provide an easier interpretation than a mere table of data. Waveforms may be displayed, which are a representation in time of the signal sent by each axes of the accelerometer. While waveforms can be displayed to the swimmer, the representation of the information in this form is not easy to interpret while swimming. Ideally, the waveforms would be displayed offline, i.e., outside of real-time, or in a second display available to coaches, that will provide more details about the workout and the swimming pattern. The information can be communicated to the swimmer via a display module 26, which could be in the form of alphanumeric characters (to indicate the number of strokes for a pool length), color schemes to indicate if a swimmer is ahead, on schedule, or behind a pace, and audio signals as previously discussed. Thus, from these signals information can be obtained about the characteristics of the swimmer's movements, including detection of start, stop, and turns, stoke count, kick count, stroke signature, and breathing pattern.

The processor 24 utilizes conventional components and will not be described in detail herein. Briefly, it includes the A/D converter 25, a serial interface 23, and communicates with a display driver 21, in one embodiment. Power is supplied to the system 20 from a power supply 17, which may be a battery for portable applications.

Figure 10:
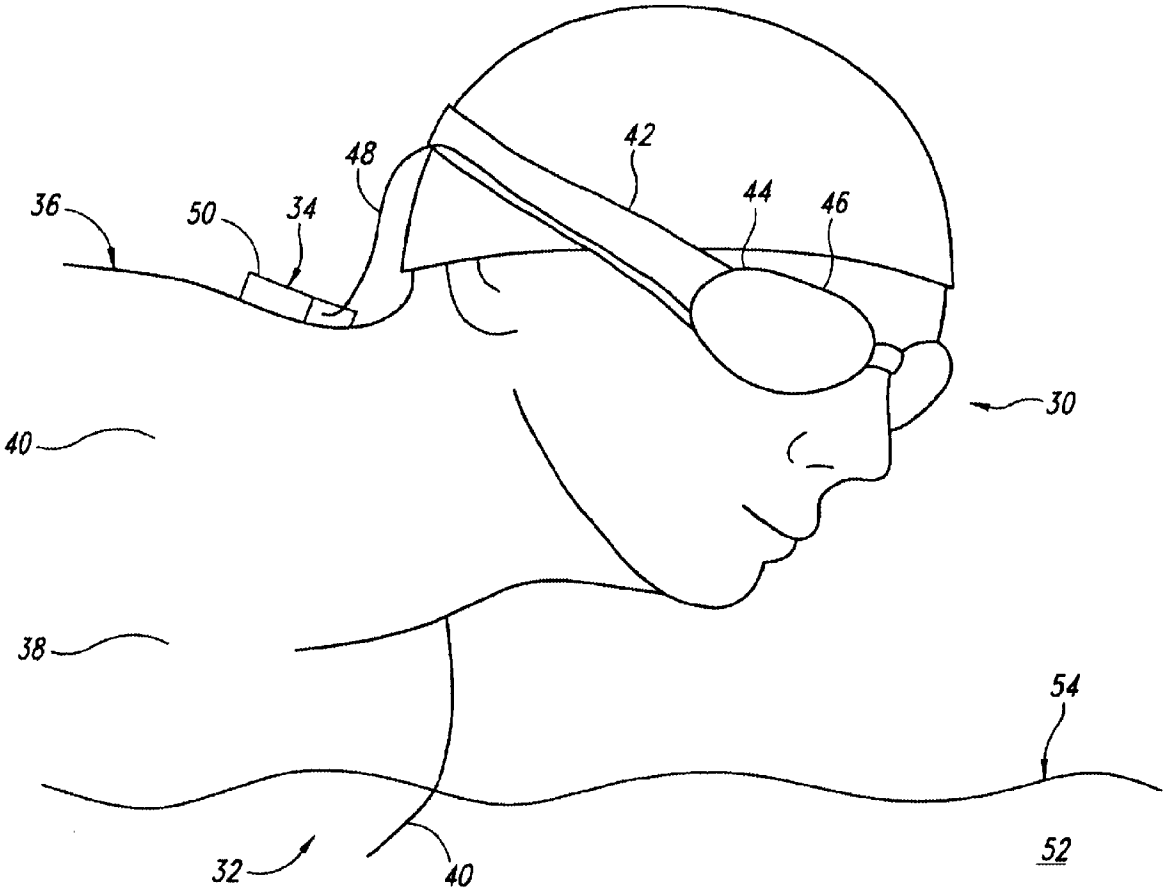
FIG. 10 is an isometric projection of the system of the present invention used in conjunction with a swimmer.

FIG. 10 illustrates the system 30 formed in accordance with the invention and configured for use with a swimmer 32. The system 30 includes a sensor assembly 34 shown mounted on the back 36 of the swimmer's torso 38. It is shown here mounted between the shoulders 40. A processor 42 and display unit 44 are mounted on the swimmer's goggles 46. In this embodiment, the sensor assembly 34 communicates with the processor 42 via a connecting wire 48. In another embodiment an RF transmitter is used to send data to the processor 42. The sensor assembly 34 may be placed on other areas of the swimmer 32 as discussed more fully herein below.

Preferably, the sensor assembly 34 includes a two-axis accelerometer 50 mounted to have the first axis Y parallel to the direction of travel, shown by the arrow T, which corresponds to the longitudinal axis of the swimmer's body when in the water 52. The second axis X is perpendicular to the Y-axis, and both axes will be approximately parallel to the surface 54 of the water 52, which is more or less horizontal, i.e., parallel to the surface of the earth.

In this orientation, the accelerometer 50 will generate a first static acceleration signal when the swimmer's torso 38 pitches up and down, such as in the butterfly stroke or breaststroke. Rotational movement of the torso 38 about the X-axis characterizes this movement. The accelerometer 50 will generate a second acceleration signal when the swimmer's torso 38 rolls, such as when performing a crawl or backstroke stroke. This movement is characterized by rotational movement of the torso 38 about the Y-axis.

Because the axes of the accelerometer 50 are essentially parallel to the earth's surface, pitching up and down of the accelerometer 50 about the X-axis and rotating the same accelerometer 50 about the Y-axis will cause the generation of an oscillating output signal with respect to the vertical axis, and such signals will have sine-wave characteristics. In other words, moving the sensitive axes of the accelerometer a few degrees (a) from the horizontal will generate a static acceleration with respect to the vertical axis, mathematically proportional to g*(sine $\alpha$), where g is the force of gravity (32.2 ft./sec.$^2$ or 9.8 m/sec.$^2$).

The placement of the sensor assembly 34 on the swimmer's body 32 has been found to be an important factor in capturing valid, reliable data. Studies conducted by the applicants found that placement of the sensor assembly 34 at one of three different locations on the swimmer's body 32 produced the most desirable results. These locations were the upper torso or back, the lower back, and to the head. Having the axes of the sensor assembly 34 as parallel as possible to the horizontal plane resulted in maximum sensitivity. When the entire system is integrated into a swimmer's goggles 46, the accelerometer will reside next to the processor 42, shown in FIG. 10, which is basically at the level of the temporal artery of the swimmer.

Automatic Detection of Start, Stop, and Turn Events

Regardless of which of the three positions the sensor assembly 34 was mounted, the execution of starts, stops, and turns is clearly detected on the first and second acceleration signals. The three events caused a sudden rupture in the periodicity of the signals and very high amplitudes.

Stroke Count

With the sensor assembly 34 attached to the swimmer's head, stroke count for the butterfly, crawl, and breaststroke was highly accurate. In addition, the swimmer's breathing pattern was clearly detectable. However, backstroke was not clearly detectable because the swimmer's head does not change pitch to the degree it does in the other three strokes.

Positioning of the sensor assembly 34 on the upper or lower back of the swimmer yielded strong periodic signals for all four strokes. The sensor assembly 34 was very sensitive to the rolling motion of the swimmer's body resulting from the arm pull in the crawl and backstroke, as well as to the pitching motion of the swimmer's body resulting from the arm pull in breaststroke and the butterfly stroke.

In addition, with the sensor assembly 34 positioned on the lower back, it is possible to detect the swimmer's kick pattern in the backstroke and crawl; and with the sensor assembly mounted on the lower extremities of the body, such as the thigh or calf, it is possible to detect the swimmer's kick pattern in all four strokes.

Breathing Pattern

The breathing pattern can readily be obtained from strokes that require the swimmer to raise and turn their head. The crawl, breaststroke, and butterfly are three examples us such patterns. In order the track the breathing pattern in these strokes, at least one accelerometer is mounted on the swimmer's head. Lifting of the head in the butterfly and breaststroke generates high-amplitude signals on the Y-axis (rotation about the X-axis), and rolling of the head for breathing in the crawl is manifested by high-amplitude signals on the X-axis (rotation about the Y-axis). Breathing patterns are not readily detectable with the sensor assembly mounted on the swimmer's back because it is difficult to detect head motion from that location.

Stroke Signature

Studies conducted on swimmer's stroke using the system of the present invention have found that each swimmer has a unique stroke signature for a given stroke. In other words, different swimmers performing the same stroke will each have a unique stroke signature. The stroke characteristics for each swimmer are distinguishable from each other by the combination of waveforms obtained from the X and Y-axes.

Because stroke signatures are swimmer dependent, calibration will be required. That is, a comparison of the signals to the "calibrated stroke signature" using known signal processing techniques, such as auto correlation, will enable automatic stroke identification.

Identification of the type of stroke is accomplished with the sensor assembly 34 mounted on either the swimmer's head or on the swimmer's back. In either location, the crawl and backstroke cause rolling of the body, generating high amplitude signals on the X-axis (rotation about the Y-axis). In contrast high amplitude signals on the Y-axis (rotation about the X-axis) are indicative of the breaststroke and the butterfly stroke. However, with the sensor assembly mounted on the swimmer's back, the distinction between the breaststroke and the butterfly stroke is subtler, yet still discernable by using the calibration technique described above. With the sensor assembly mounted on the swimmer's back, the same is true for the distinction between crawl and backstroke, and the calibration technique described above also solves the problem. However, when the sensor assembly is mounted around the head or on the upper torso, the distinction between crawl and backstroke is obvious. This is due to the fact that signals generated by rotation of the head for breathing will be registered on the longitudinal axis, whereas no signal will be recorded on the longitudinal axis in backstroke (the head does not need to rotate for breathing). The difference between breaststroke and butterfly remains subtler regardless of the position of the sensor on the swimmer's body. Generally, the period of the acceleration signals distinguishes the butterfly and breaststrokes, with the breaststroke characterized by a larger period, regardless of the swimmer's abilities in performing the strokes.

The processor 42 is configured to process the acceleration signals for extraction of the periodicity of the signal. Initially, the two acceleration signals are converted to digital form and are filtered using a time averaging technique to remove high frequency components.

One of two techniques is then used to extract the periodicity of the signals, peak detection, and auto-correlation. Peak detection is used to extract the stroke count from the signals. However, it can be combined with auto-correlation to determine the periodicity of the signal and thus the stroke count. In the second case, the auto-correlation method is used to validate peak detection.

Peak detection is also used for analysis of the breathing pattern. The motion of the head during breathing creates peaks of larger amplitude. A comparison of the amplitude of the peaks, as well as their sign, for the crawl stroke indicates when the swimmer is breathing and on which side of the body.

The auto-correlation method can be used to detect ruptures in the periodicity, which are indications of start, stop, and turn events. These events are also characterized by large amplitude spikes on one or both of the axes. The peak detection combined with signal slope analysis can be used to confirm the results of the auto-correlation analysis.

A correlation technique is also used to identify stroke signature. The received signal is correlated with a calibrated signal recorded for each of the swimmer's strokes. The correlation technique is based on the sum of the squared difference of amplitudes between the signal being analyzed and a reference signal. A simpler method to detect turns is a direct exploitation of the peak detection algorithm. For each peak detected the time reference is known (i.e. when the peak occurred in the time scale). Because turns are characterized by a rupture of periodicity of the signal, the interval of time between the two peaks is no longer the same, which is an indication that a turn has occurred. If necessary, this information can be confirmed by using an auto-correlation of the signal.

Optionally, another technique that can be used to produce a finer analysis comprises identifying secondary oscillations by comparing the raw signal to the envelop of that same signal around peak values. The frequency of such oscillations can be detected by well-known analysis techniques over large periods of time, validating breathing patterns for example or rotation of the body while swimming. Such analysis techniques include the Fast Fourier Transform (FFT).

Referring next to FIGS. 11–14, shown therein are examples of waveform signals corresponding to the four strokes using the device of the present invention. As previously explained, static acceleration signals are used to extract information regarding stroke count, breathing pattern, stroke identification, starts, turns, lap counts, etc. The static acceleration signals are directly linked to the orientation of the accelerometer or transducer towards the vertical axis by the relation $g^*(\cos(\pi/2-\alpha))$ with $(\pi/2-\alpha)$ corresponding to the angle between the position of the accelerometer and the vertical axis. When $\alpha=\pi/2$, $\cos(\pi/2-\alpha)=1$, and the static acceleration is maximum. This corresponds to a vertical orientation of the accelerometer. When $\alpha=0$, $\cos(\pi/2-\alpha)=0$, and there is no static acceleration. This situation corresponds to a horizontal position of the accelerometer.

In the description corresponding to FIGS. 11–14, as well as FIGS. 15–18, a peak value of a waveform corresponds to a position of the corresponding axis of the accelerometer as close as possible to the vertical. And when the signal crosses the baseline or X-axis, this indicates that the corresponding axis of the accelerometer was aligned along the horizontal axis. In each of FIGS. 11–18, the accelerometer was located in the lower back of a female swimmer. In the generated signals, the first waveform 110 is generated from signals received on the Y-axis, which corresponds to the swimmer's back pitching about the axis through the hips, which is the X-axis; and the second waveform 112 is generated from signals received on the X-axis, which corresponds to rotation of the swimmer's body about the longitudinal axis, which is the Y-axis.

It is important to note that the peaks of the first and second waveforms 110, 112 correspond to the maximum angle between the position of the accelerometer and the horizontal plane, which is also the minimum angle between the position of the accelerometer and the vertical axis. Peaks on the waveform do not necessarily correspond to a particular position of the swimmer's arms. However, because undulation or pitches of the body about the X-axis and rotation of the body about the Y-axis result from the action of one arm, such as the crawl and backstroke, or of both arms together, such as during the butterfly and the backstroke, the number of peaks of static acceleration will equal the number of strokes.

It is also important to note that the sensitivity of the sensor to dynamic acceleration depends very much on the location of the sensor. If the accelerometer were placed at the fingertips of a swimmer, the dynamic acceleration would be more noticeable. Yet, regardless of the location of the sensor, angular variations from the vertical axis corresponding to static acceleration are always clearly detectable. The motion of the hand under water is such that a sensor positioned at the fingertips would create a very strong static acceleration as well as dynamic acceleration.

Figure 11B:
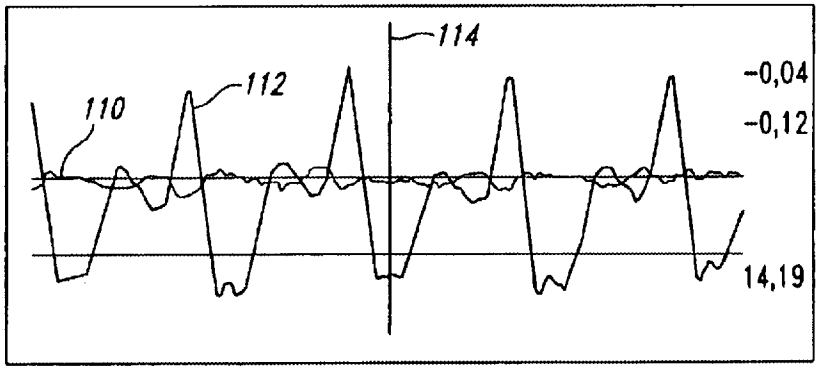
FIGS. 11A–11B, 12A–12B, 13A–13B, and 14A–14B are illustrations of waveform displays generated in conjunction with corresponding illustrated butterfly, breastroke, crawl, and backstrokes, respectively, as actually performed by a swimmer.
Figure 11A:
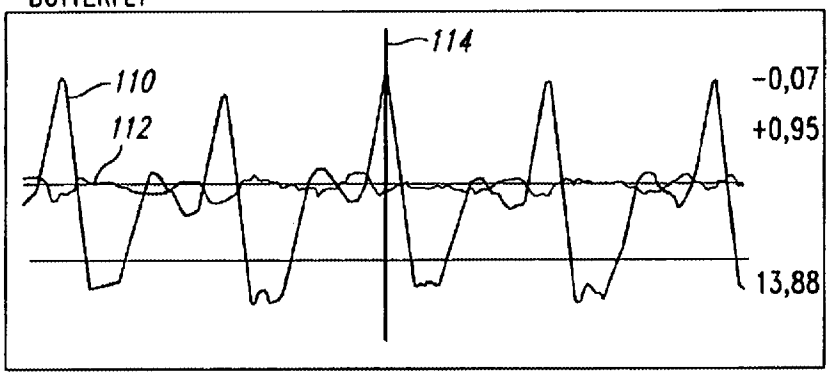

Referring first to FIG. 11A, here the swimmer's back is angled upward toward the vertical axis and the lower back, where the accelerometer is attached, is at a maximum positive angle from the horizontal plane (minimum angle from the vertical axis). For this particular swimmer, this situation corresponds to the middle of the arm recovery. The vertical line 114 in FIG. 11A bisects a peak of the first waveform 110, showing the moment in time at which the video frame was taken. In FIG. 11B, the lower back is at a maximum negative angle from the horizontal plane (corresponding to a minimum angle from the vertical axis), and this corresponds to the end of the arm recovery for this particular swimmer. Here the vertical line 114 passes through a trough or negative peak of the first waveform 110, corresponding to the maximum negative angle from the horizontal plane of the swimmer's lower back.

Figure 12B:
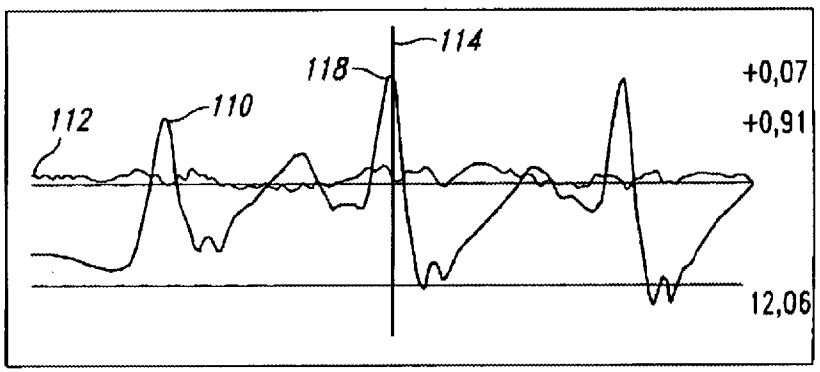
Figure 12A:
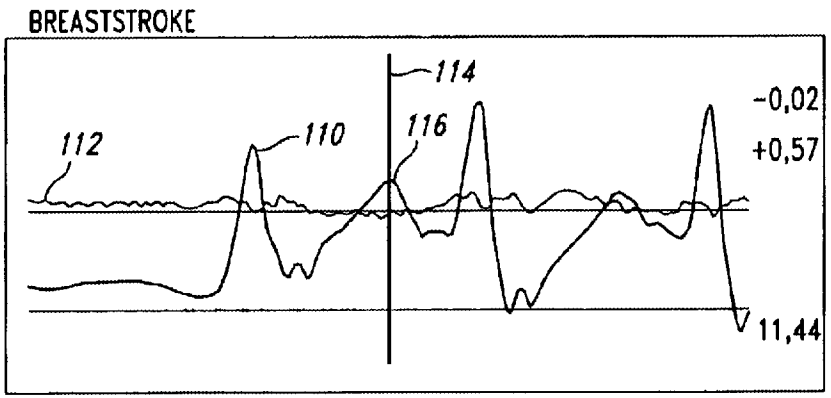

FIGS. 12A and 12B show waveforms corresponding to the breaststroke. When the accelerometer is positioned on the lower back, breaststroke signals have the unique particularity of showing a clear mix of static and dynamic acceleration. Whereas the contribution of a dynamic acceleration is much more difficult to notice with other strokes, it can be seen more clearly in the breaststroke waveform signals.

As can be seen from FIGS. 12A–12B, undulations of the body in the breaststroke are reflected by large digressions of the first waveform signal 110 on the Y-axis and no significant information is detected on the X-axis. In FIG. 12A, the reference line 114 passes through a peak 116 that corresponds to a peak of static acceleration. The upper part of the swimmer's body is rising to its highest position, while the arms begin recovery and the legs are pulling towards the buttocks. The position of the body is such that the accelerometer is at an angle to the horizontal plane, creating the peak of static acceleration. In FIG. 12B, the larger and narrower peak 118 of the first waveform signal 110 is a peak of dynamic acceleration. This corresponds to the phase of energetic and fast kicking with both legs.

Figure 13B:
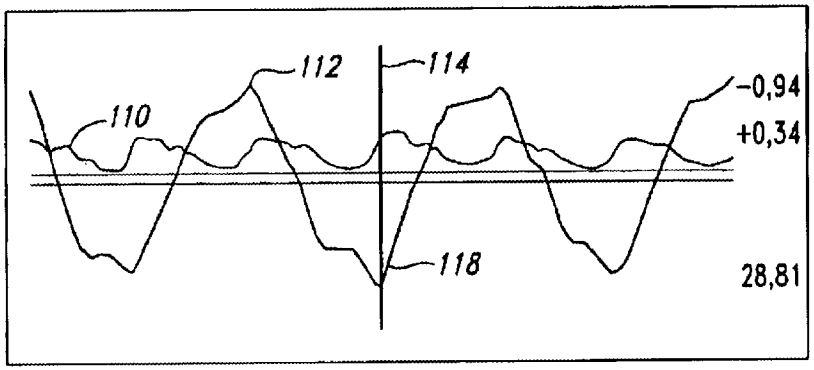
Figure 13A:
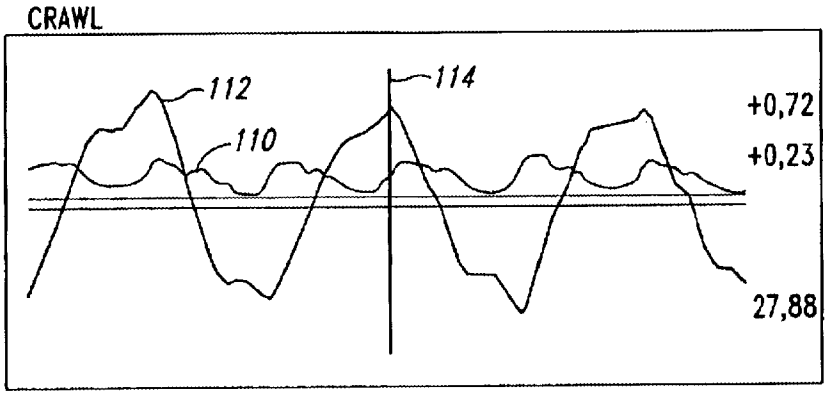

FIGS. 13A and 13B show a swimmer performing the crawl. In this stroke, the rolling of the body about the longitudinal axis (Y-axis) creates strong signals of static acceleration as shown in the second waveform signal 112. The kick during the crawl stroke is responsible for the periodicity observed in the first waveform 110, principally due to the proximity of the sensor to the legs. The up-and-down motion of the legs is responsible for the pitch detection by the sensor along the longitudinal axis, the Y-axis (corresponding to rotation about the X-axis).

In these figures, the breathing pattern is not clearly detected because of the location of the sensor on the body. However, each breath is marked by a signal of higher amplitude. For breathing pattern detection, the sensor can be ideally positioned on top of the swimmer's head.

Referring to FIG. 13A, the swimmer is performing the crawl, and in this figure the rotation of the body towards the swimmer's left, with the left side deep in the water. This is shown to be at a maximum as indicated by the reference line 114 through the second waveform signal 112. In FIG. 13B, the rotation of the body towards the right (right side deep in the water) is at a maximum, shown by the position of the reference line 114 in the trough 118 or negative peak in the second waveform signal 112. Thus, the left and right rotations of the body are of opposite sine.

Figure 14B:
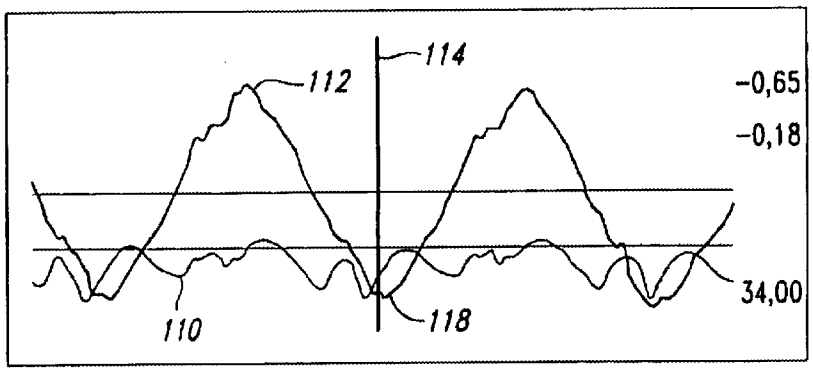
Figure 14A:
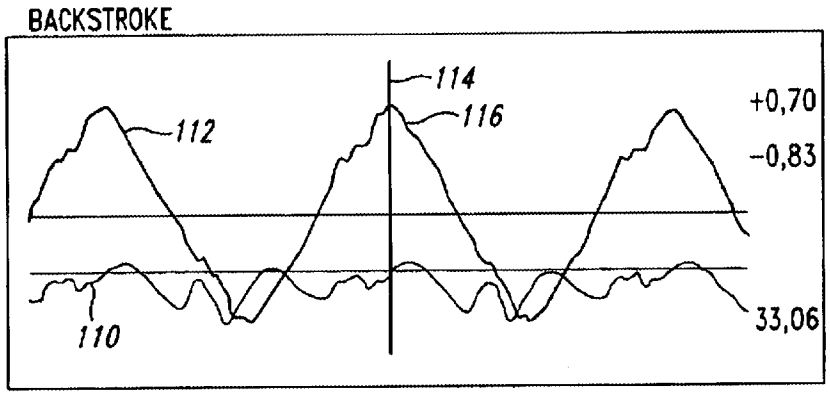

The backstroke is illustrated in FIGS. 14A–14B. A similar pattern as in the crawl is observed here. The rolling of the body in this stroke also creates strong signals of static acceleration on the second waveform signal 112, generated by rotation of the body about the longitudinal axis (Y-axis), corresponding to static acceleration on the X-axis (the transverse axis). Kicking of the legs in the backstroke is responsible for the periodicity observed on the first waveform signal 110, principally due to the proximity of the sensor to the legs. As in the crawl, the up-and-down motion of the legs is responsible for the slight pitch detected by the sensor along the Y-axis.

In FIG. 14A, the rotation of the body towards the swimmer's left, with the left side deep in the water, is at a maximum. This is shown by the reference line 114 passing through the peak 116 on the second waveform signal 112. In FIG. 14B, the rotation of the body towards the right, with the right side deep in the water, is at a maximum. This is shown by the position of the reference line 114 passing through a trough or negative peak 118 in the second waveform signal 112. Here, the left and right rotations are of opposite sine.

Figure 15B:
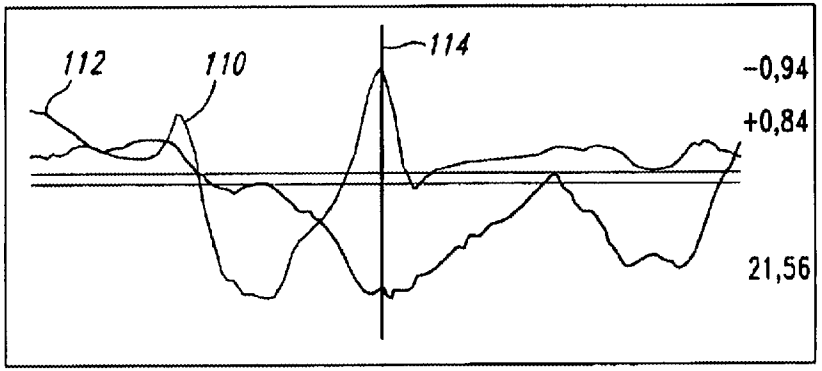
FIGS. 15A–15B, 16, and 17 are illustrations of waveform displays generated in conjunction with illustrated flip turns and two starts, respectively, as actually performed by a swimmer.
Figure 15A:
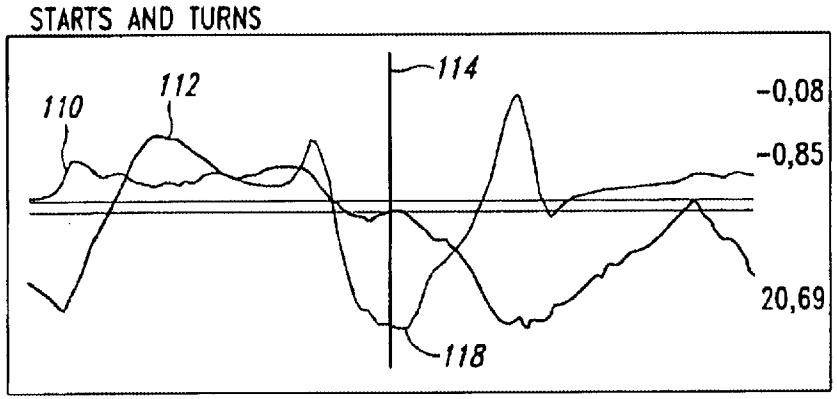

Starts and turns are also easily detectable from the waveform signals. For example, during a flip turn in crawl, the pitching of the body about the X-axis (along the Y-axis) generates a signal of large amplitude, as shown in FIG. 15A, where the reference line 114 is passing through a trough or negative peak 118 in the first waveform signal 110. In FIG. 15B, the positive spike in the first waveform 110, which is indicated by the reference line 114, results from the dynamic acceleration created by the violent push-off from the wall. In FIGS. 15A and 15B, there is an obvious rupture of periodicity in the first waveform signal 110.

Figure 17:
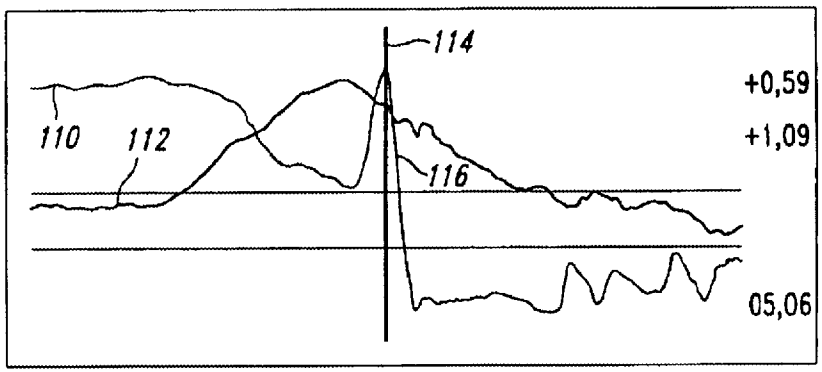
Figure 16:
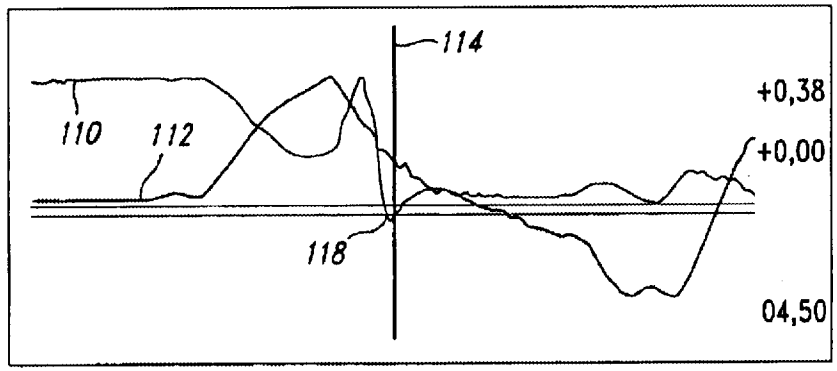

Turning next to FIG. 16, a similar spike on the first waveform 110 in the negative direction, creating a trough 118, as indicated by reference line 114, corresponds to the beginning of the start in the crawl. FIG. 17 shows a similar positive spike 116 on the first waveform signal 110 at the start of the backstroke. These spikes are generated because the swimmer is pushing off strongly from the wall, as discussed above with respect to FIG. 15B. Similar spikes can be observed on the second waveform 112 for starts in the butterfly and breaststroke because of pushing off from the wall.

Figure 18:
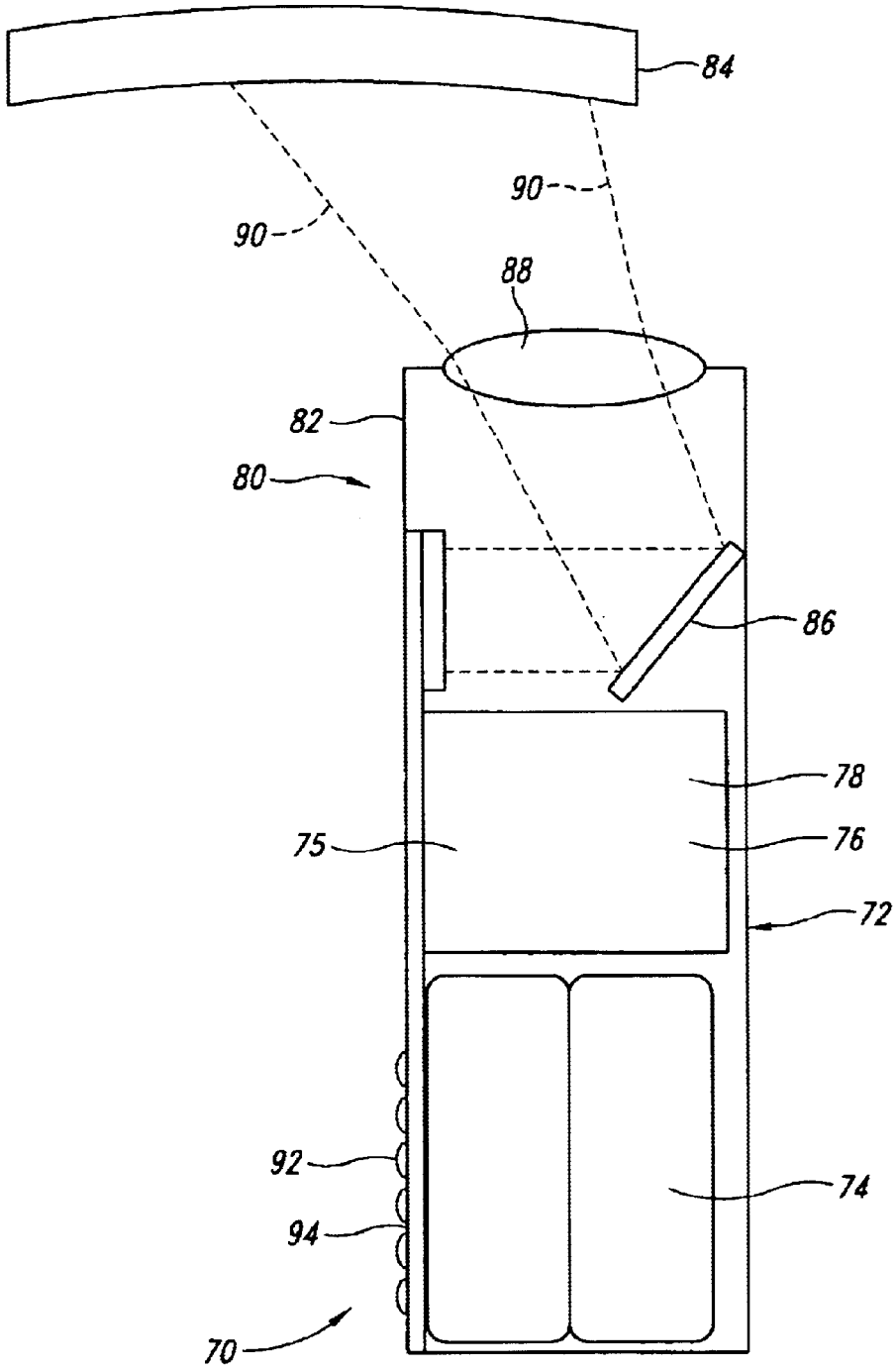
FIG. 18 is a diagram of one embodiment of the sensing and display system for goggles formed in a accordance with the present invention.

Referring next to FIG. 18, shown therein is a representation of another embodiment of the invention wherein the system 70 is formed as a single unit. A housing 72 is provided that includes batteries 74, a circuit board 75 containing the sensor assembly 76, and the processor electronics 78. A display unit 80 is provided at one end 82 of the housing 72 that includes a display panel 84, a mirror 86, and an objective lens 88 through which the mirror 86 reflects the displayed image (represented by dotted lines 90) from the display panel 84. Contacts 92 are provided on the side 94 of the housing 72, which can be used for external connections, such as charging the batteries 74, connecting to a transmitter, or coupling to a second display device for external viewing. In one embodiment, infra-red (IrDA) connections can be used for transmitting data. These connections offer the advantage of no direct exposure to the water, solving issues regarding waterproofing, and not cords are necessary. For battery charging, an induction charging technique can be used to avoid connectors and cords.

The self-contained system 70 is designed for mounting to the swimmer's goggles such that the displayed image is viewable by the swimmer while swimming. In this case, the image projected through the objective lens 88 is received at an eyeglass lens 84 that is formed as part of the swimmer's goggles. With this system, the swimmer will have a real time, continuous visual display of their performance. An example display is shown in FIG. 46.

Figure 46:
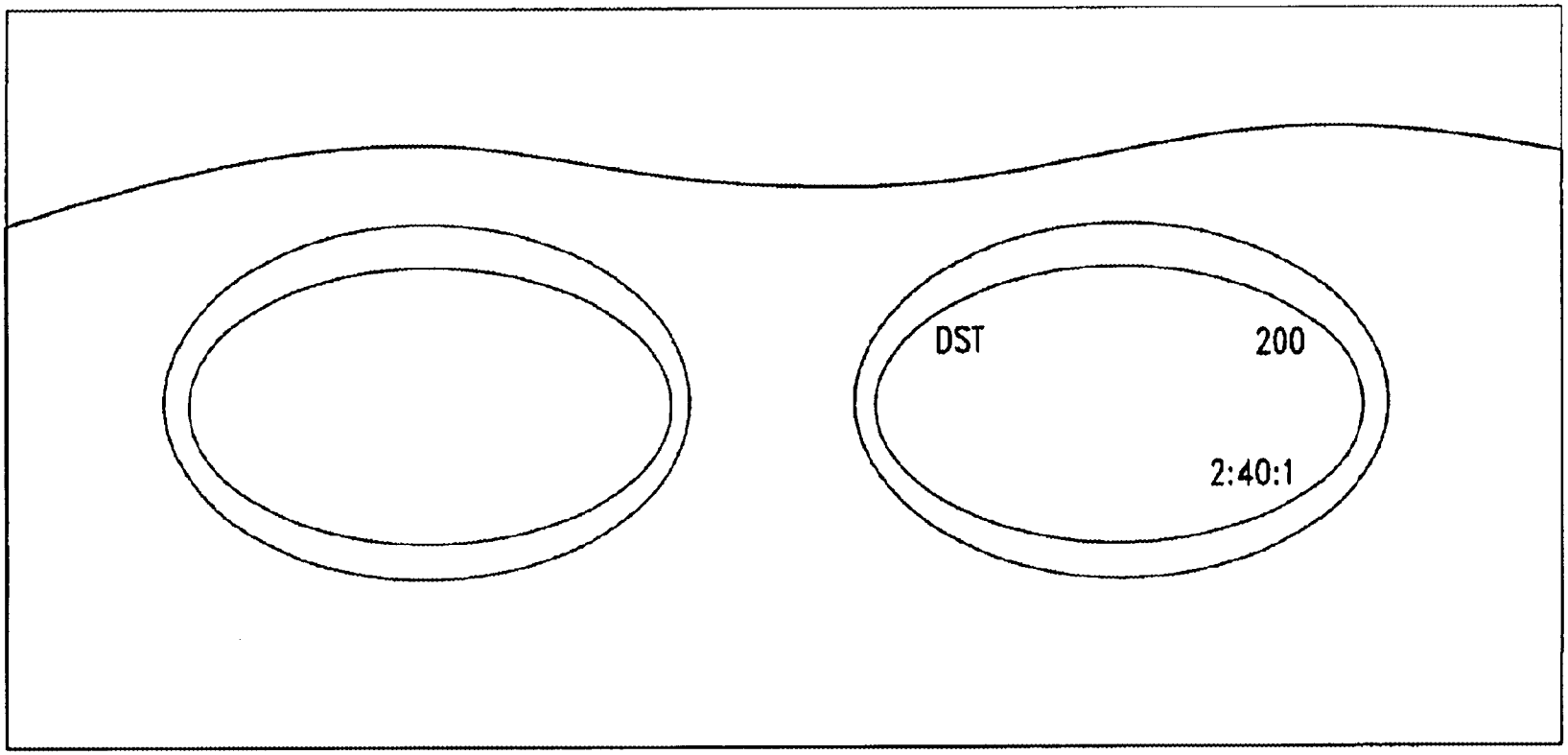
FIG. 46 is an illustration of the display of information through the goggles as seen by the swimmer.

FIG. 46 is an illustration of the display of information through the swimmer's goggles as seen by the swimmer. The display shows distance (DST) covered and the elapsed time. It is to be understood that other information may be displayed to the swimmer, such as stroke count, start time, and breathing patterns.

The display may also be configured to use an LED display that projects a 45-degree lens. A portion of the light passes through the lens to a reflective surface at the bottom of the goggle structure. The light is reflected back to the lens and the 45-degree inclination directs the light to the retina of the swimmer.

An optional earpiece (not shown) can be used to provide an audible signal to the swimmer. In one embodiment, the swimmer can hear changes in the pitch of the waveform signal and determine their performance therefrom. A pitch can also be broadcast from a reference waveform, and the pitch corresponding to the action of the swimmer superimposed on the reference waveform. When both pitches match, the swimmer will hear a single tone, indicating the swimmer is in synch with the reference pattern. Information such as lap count, stroke count, elapsed time, etc., may also be provided through the earpiece in natural language using a voice synthesizer.

The described embodiments of the invention implement a unique method of detecting, tracking, processing, and displaying information about a swimmer's performance, and in a broader context, in monitoring repetitive movement of the human body in a variety of activities. This can include physical therapy where the amplitude of each movement can be monitored to determine if they are the same and whether they are increasing from one physiotherapy session to the next. The method can apply to sensing acceleration of specific areas of the body, preferably static acceleration about two perpendicular axes that are parallel to the earth's surface, and processing the acceleration signals generated therefrom to identify the movement, display the movement pattern, including the breathing pattern, and determining movement start, stop, directional change of travel, and movement count. The processed information is then displayed for the user to see or hear, as well as for coaches and spectators to monitor in real time. The sensor output may also be sent over the Internet for offline processing and analysis by coaches, physiotherapists, etc. The waveforms can then be more fully analyzed for a finer interpretation of the swimmer's performance.

What follows next is a brief description of the software component of the present invention. It is configured, in part, to deal with the important feature of detecting peaks (minimums and maximums) from the data received from both axes of the accelerometer. Such peaks are directly related to the repetitive motion, such as stroke count for the swimmer, and they also provide an excellent indicator of periodicity. This information can be compared to the results of an auto correlation method, which is the second technique used to detect periodicities in the signal. Ruptures of periodicity, as well as analysis of the amplitude of the signal are both used to detect turns, starts and stops.

Figure 19:
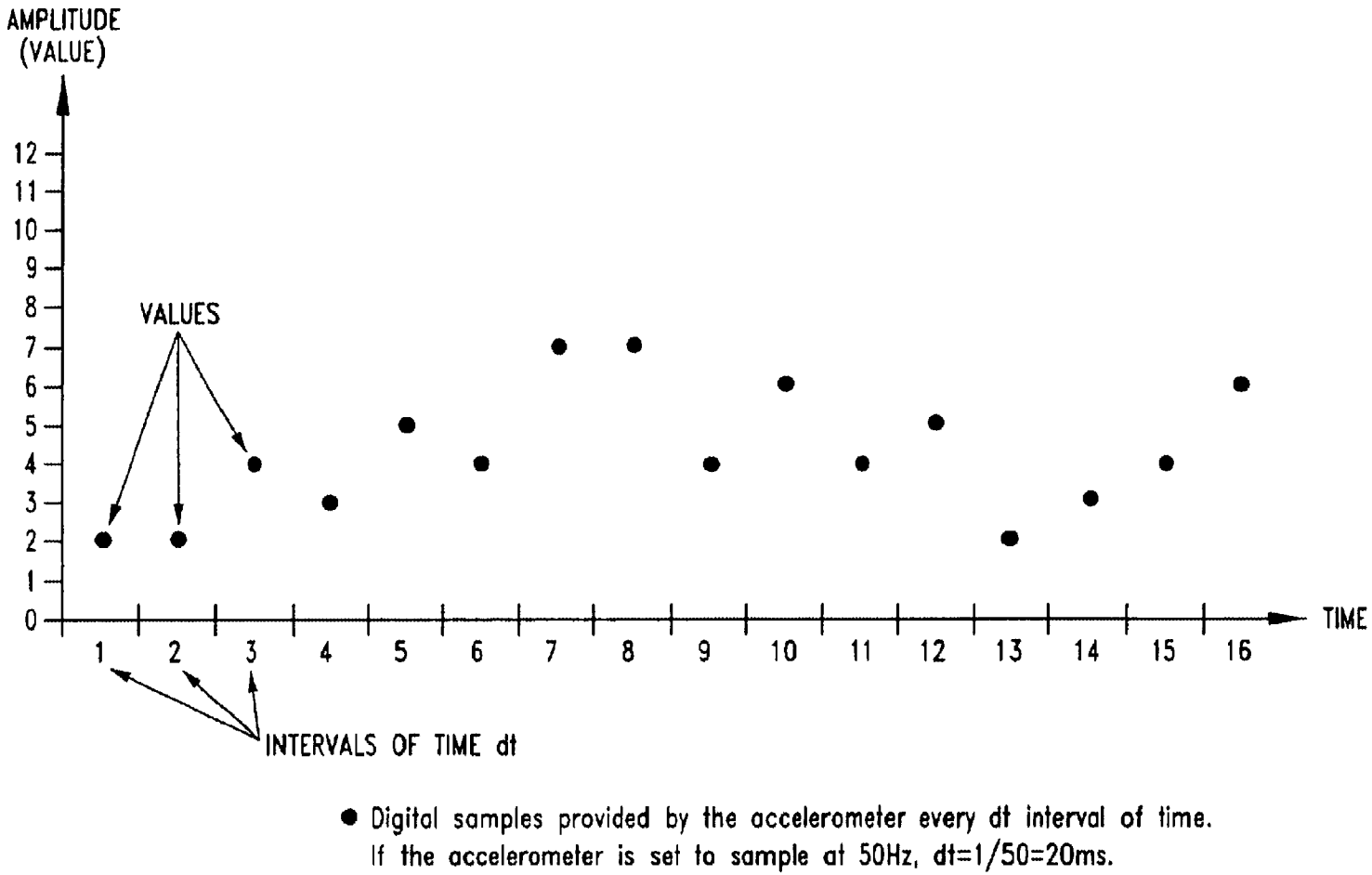
FIGS. 19–20 are plots of digital samples illustrating intervals of confidence.

FIG. 19 shows the values of digital samples directly received by one of the two axes of the accelerometer every interval of time dt. The sample rate of the accelerometer is controlled at 50 Hz; therefore $dt=1/50$ which is 20 ms.

Peak detection based on an interval of confidence will now be discussed. Regarding the interval of confidence, a simple observation over a very large sample of swimmers shows that the four types of strokes are swum at a frequency of 1 to 2 seconds per stroke (1 to 0.5 Hz). In addition, the results of trials conducted by the applicants show the waveform representation of each stroke comparable to a sine wave in that it has periodicity with peaks and valleys. When the accelerometer is set to sample at 50 Hz (50 times per second or one sample every 20 ms), 50 to 100 samples would be necessary to represent the waveform associated to one stroke.

The peak detection method is based on the comparison of one sample value to its closest neighbors. The number of samples used for the comparison defines an interval of confidence from which we declare a sample as a peak (see FIG. 20). Based on our comments in the previous paragraph, it is legitimate to consider an interval of confidence in the order of magnitude of 1 to 2 seconds (the period of the signal we observe). This means that the system will compare the value of each sample to its immediate 25 neighbors to the left and to its immediate 25 neighbors to the right if a stroke frequency of 1 second is used, and immediate 50 neighbors on each side if a stroke frequency of 2 seconds is used. It is to be noted that the total number of samples involved in this discussion is in fact 25+1+25 or 50+1+50, as it simplifies the understanding and illustrations in this document. This means that the interval of confidence represents 1020 ms (51 samples×20 ms). However, a sample can be compared to 25 neighbors to the left and only 24 neighbors to the right to deal with 25+1+24=50 samples representing strictly 1 second.

Figure 20:
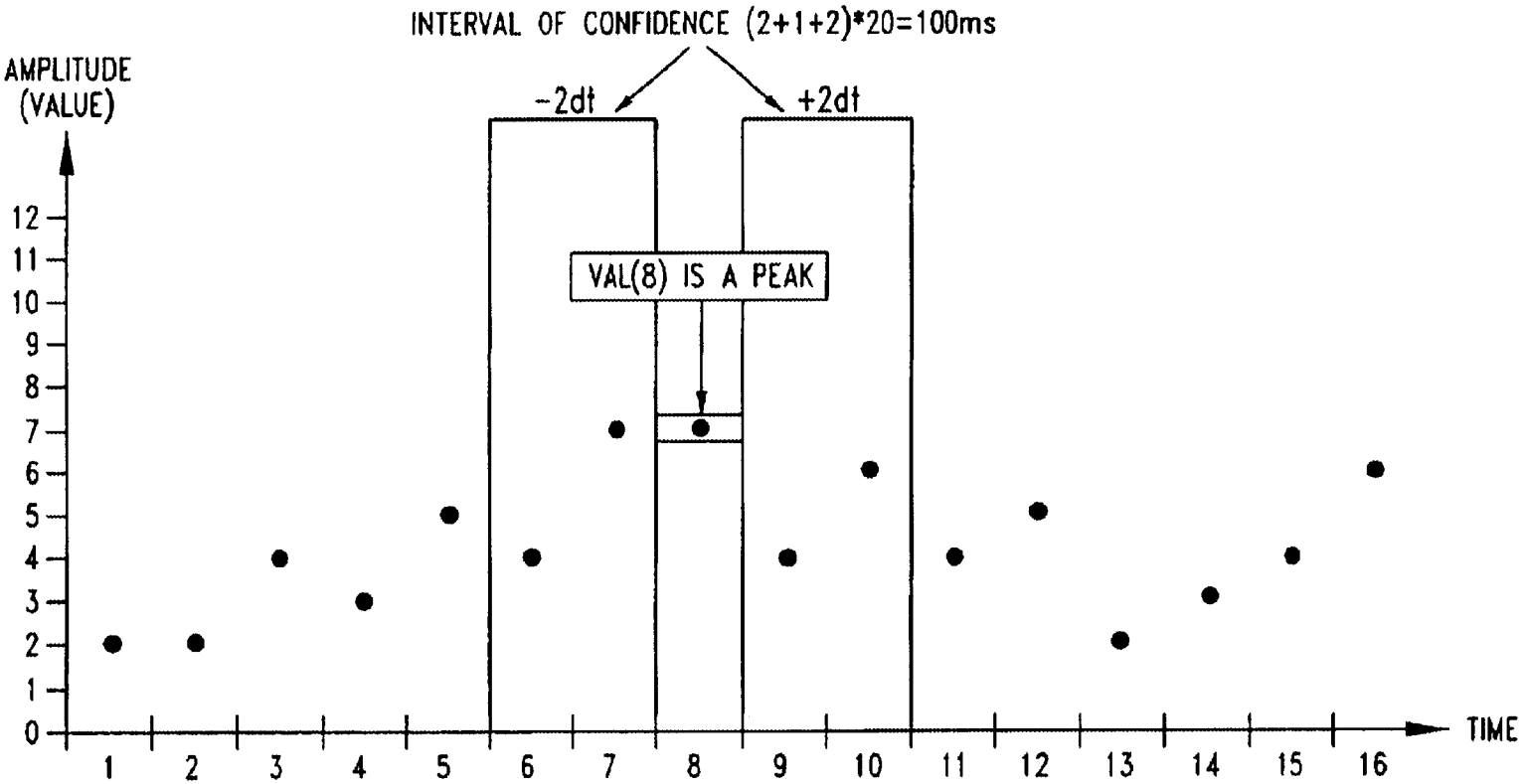

For simplicity and illustration purpose of this concept, the balance of the description will consider an interval of confidence of 100 ms represented by one sample compared to its two immediate neighbors on each side (see FIG. 20). Also, the description will be directed only to the detection of a maximum. The methodology is essentially the same for the detection of a minimum.

In FIG. 20, for the value of sample 8 to be considered a peak, it must be greater or equal than Val(6), Val (7), Val(9) and Val (10). If one of these values is greater than Val (8), then Val(8) cannot be retained as a maximum. In the case of FIG. 20, Val(8) is a maximum.

Based on the foregoing, it can be understood that selecting an interval of confidence too small would lead to potentially detecting too many peaks; whereas choosing an interval of confidence too large would result in getting the opposite effect, i.e. detecting too few peaks.

Of course, the comparison of a sample to its closest neighbors to the right cannot occur until these data have been captured (2dt=2*20 milliseconds later for this example, or ½ second to 1 second later in a real case).

Figure 21:
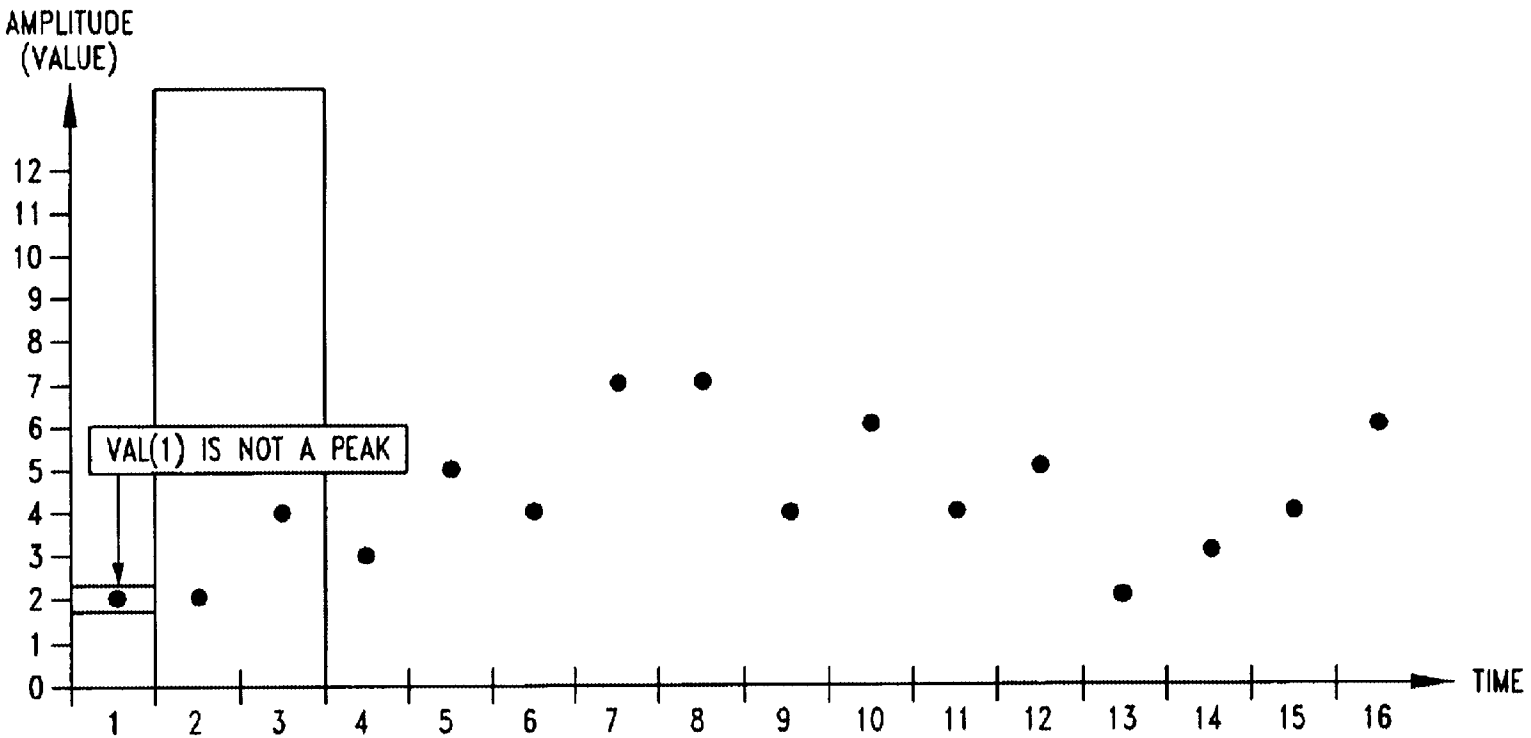
FIGS. 21–25 are plots of digital samples showing a first method of peak detection.
Figure 22:
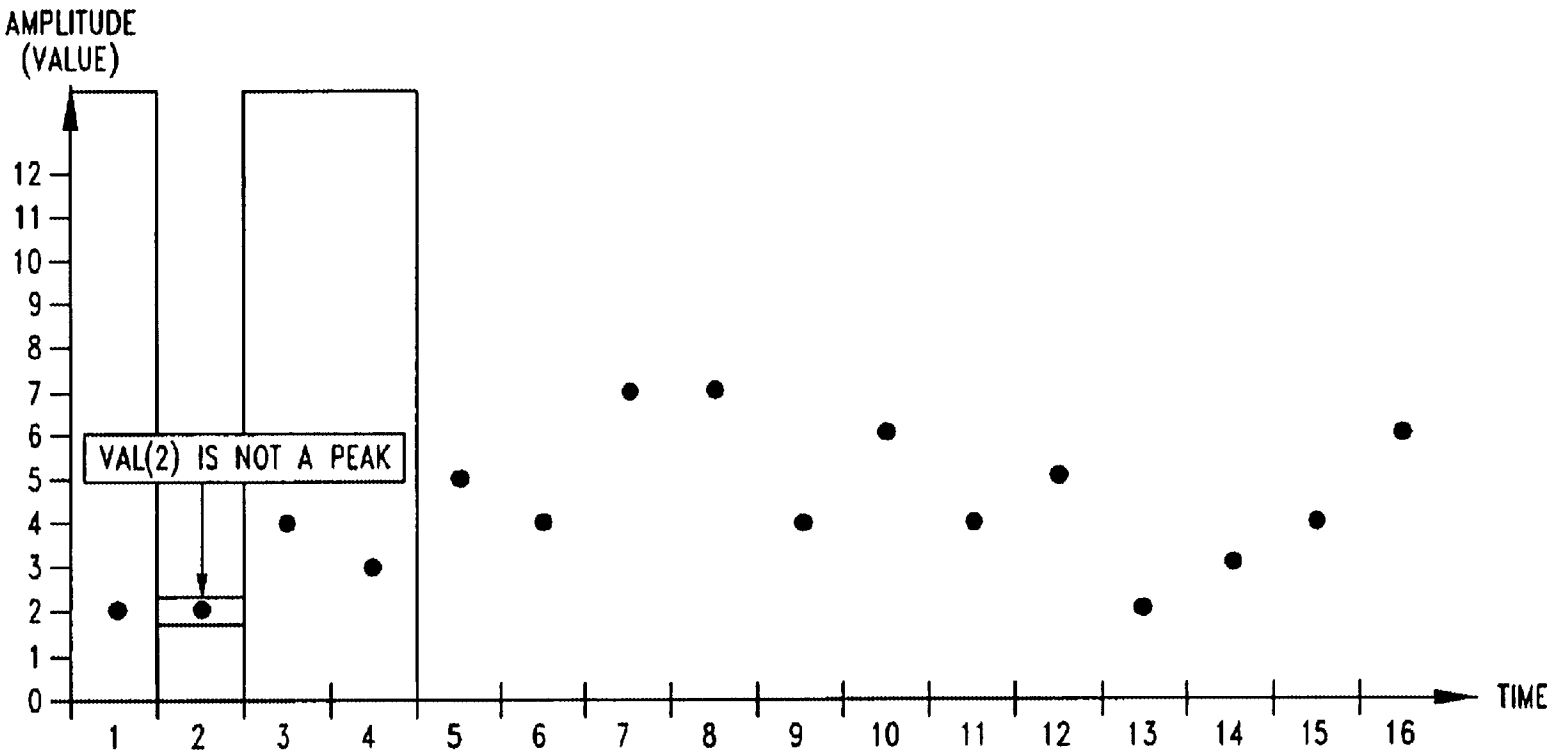
Figure 23:
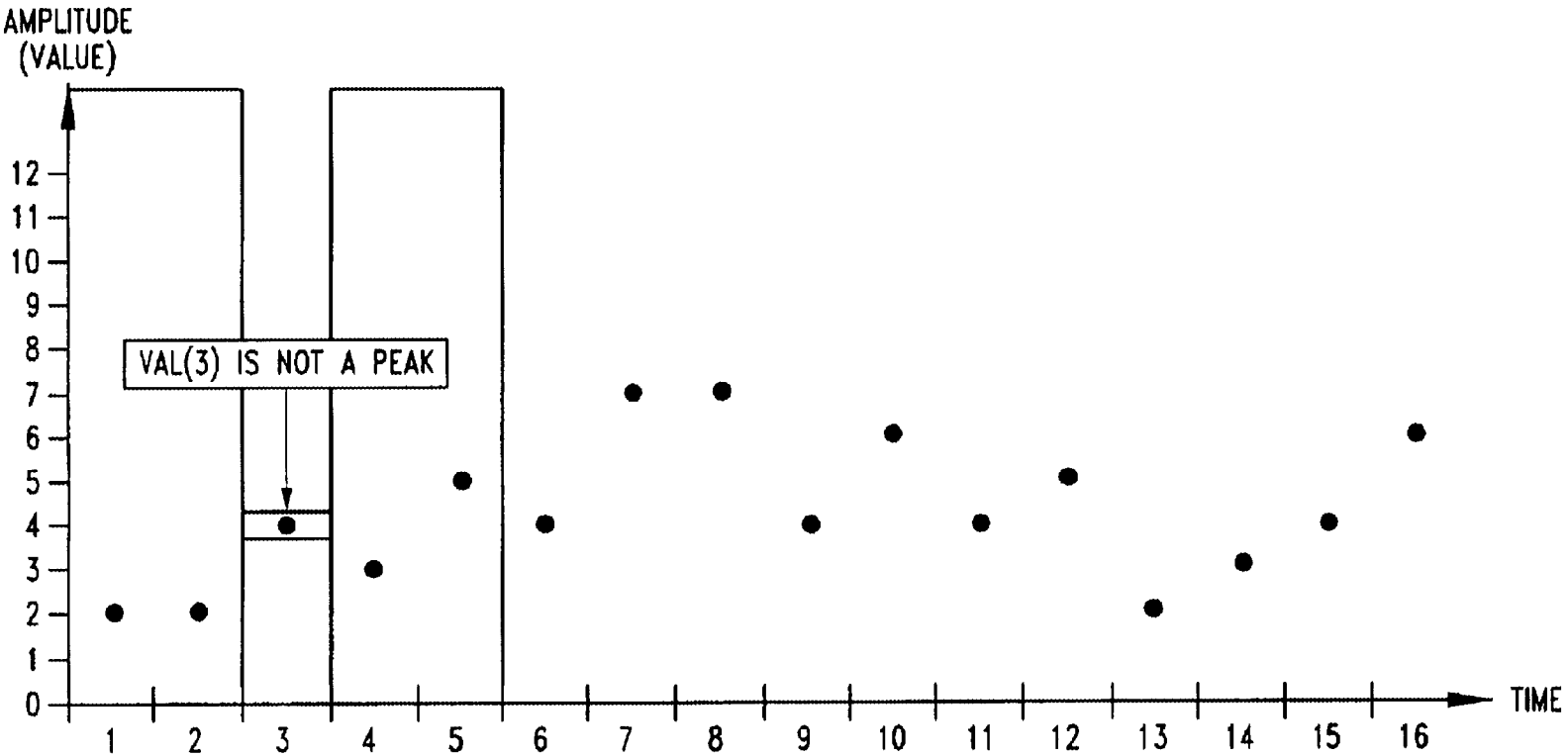
Figure 24:
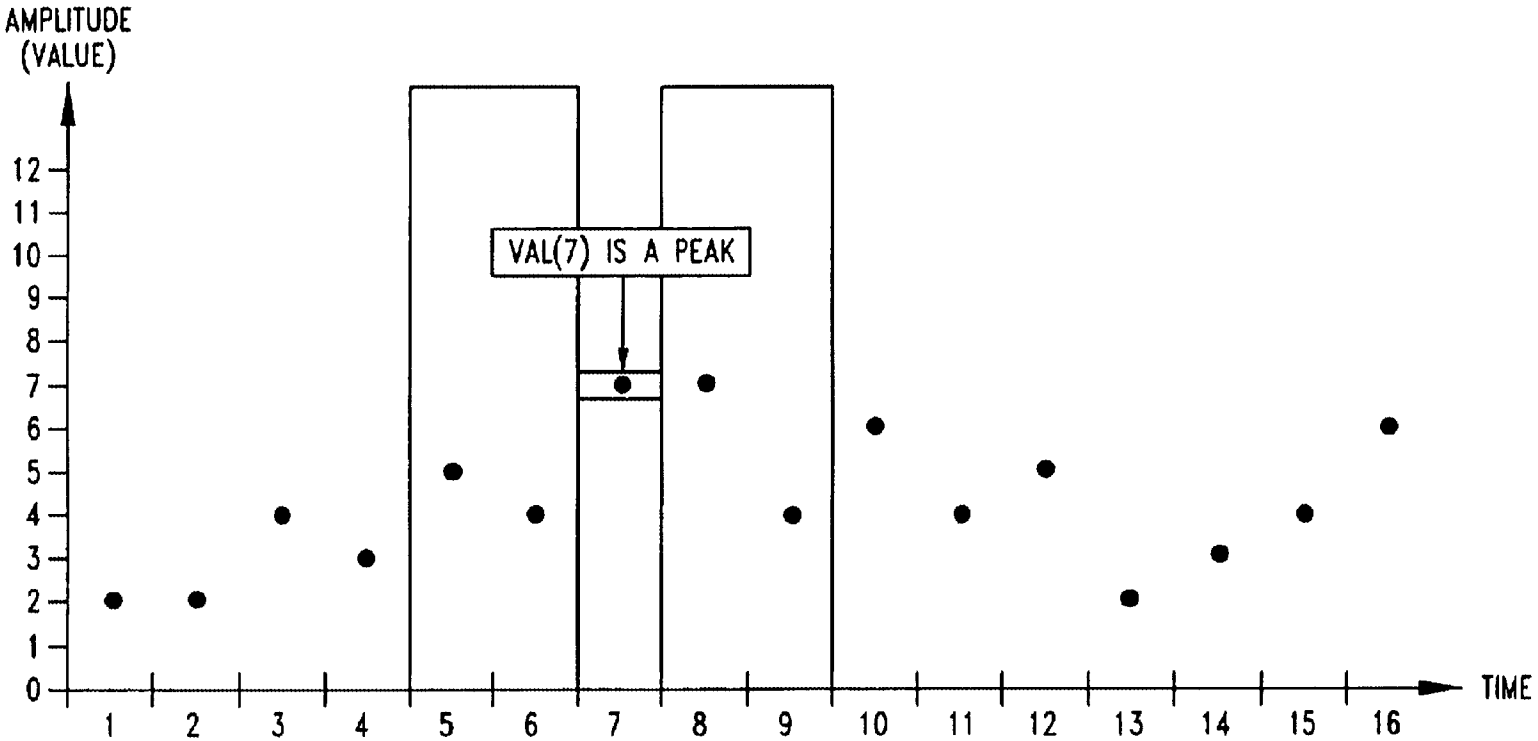
Figure 25:
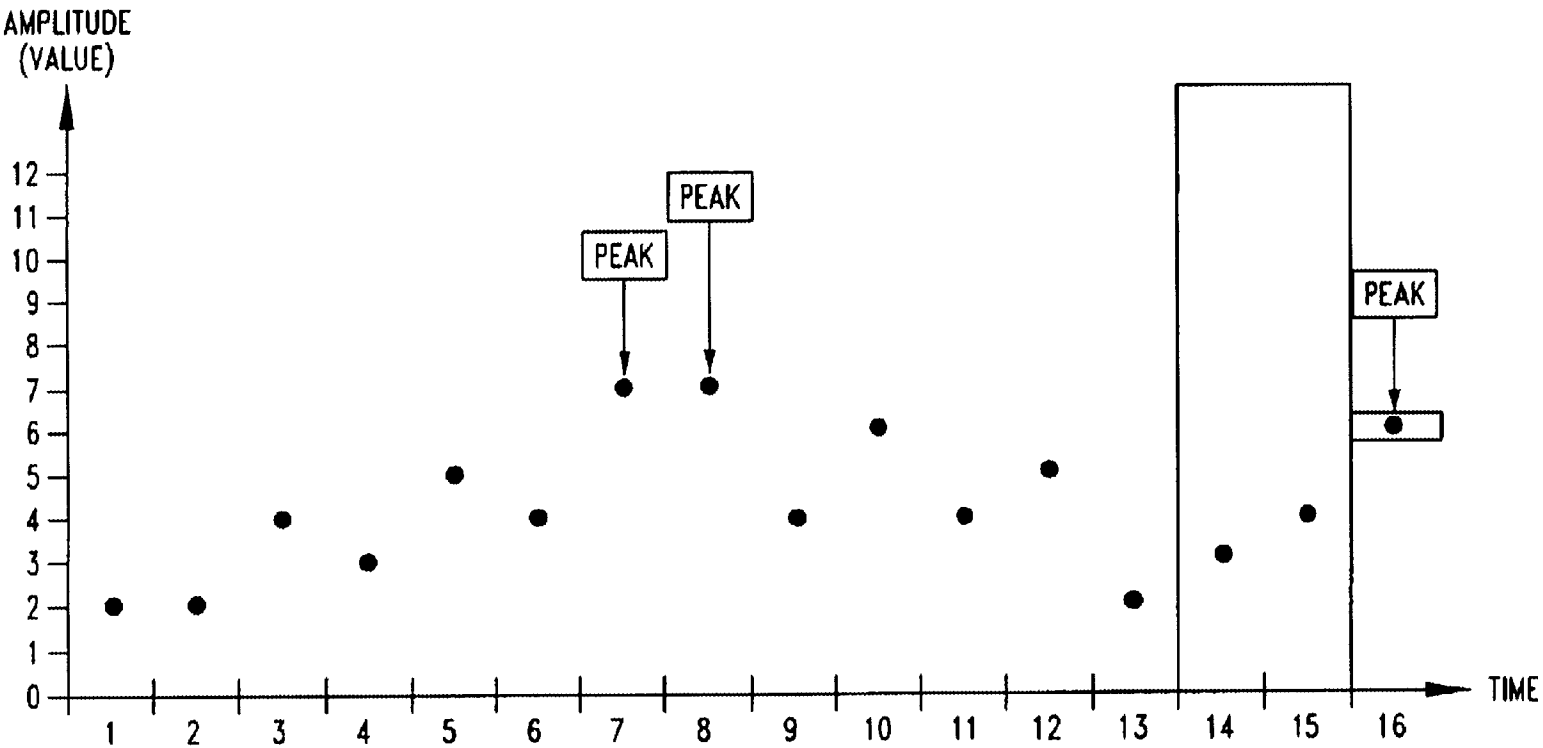

The algorithm would propagate as illustrated in FIGS. 21–25. In FIG. 21, the first digital sample is compared to its two closest neighbors to the right, and no data is available to the left. In FIG. 22, the second digital sample is compared to its two closest neighbors to the right and a unique neighbor to the left. Next, in FIG. 23, the third digital sample is compared to its two closest neighbors to the right and left (a general situation). The seventh digital sample shown in FIG. 24 is a peak. The last sample shown in FIG. 25 is compared to its two closest neighbors to the left. A total of three peaks were detected by the system.

As explained earlier, it is important to choose an interval of confidence slightly shorter than the stroke frequency of the swimmer. The system can automatically determine the optimal interval of confidence by testing different potential values for the interval that would be applied to the first samples sent by the accelerometer. From the series of peaks extracted by the algorithm for each interval of confidence, the system will identify the peaks showing the best periodicity and retain the associated interval of confidence.

A second solution would consist in using an auto-correlation method. The system would regularly perform an auto-correlation over a few cycles of the signal, in order to assess the periodicity of the signal and adjust the duration of the interval of confidence accordingly.

However, a direct implementation of such a peak detection algorithm would be impractical because the number of operations would quickly overload the microprocessor. This number is proportional to: (the total number of samples)× (the number of samples defining the interval of confidence). As a result, peak detection would not occur in real time and the power consumption of the microprocessor would become a serious issue.

Also, as shown in FIG. 25, two peaks are detected for two adjacent samples, which indeed should be treated as one single peak. Therefore the applicants have developed a faster algorithm based on the same principle, but involving far less microprocessor operations and solving the issue of duplicate peaks.

A real time algorithm will now be described. Based on the theory presented in the previous section, it can be observed that two consecutive maxima or two consecutive minima are always separated by at least n/2 samples when considering an interval of confidence of n+1 samples (n/2 on each side of the sample being evaluated as a possible peak).

It can also be observed that a peak detected in an interval of confidence n, is also a peak for any interval of confidence smaller than n, in particular for an interval of 3 (i.e. a sample is compared to its left and right neighbors).

Therefore, a fast algorithm is provided that is based on the comparison of a sample to its immediate left and right neighbors and that considers the sample to be a peak candidate if it is the greatest of the three (when looking for a maximum). Then, this candidate is compared to all the other peak candidates found among the next n/2 samples. The greatest among them shall be retained as a peak for an interval of confidence n+1. With this approach, a sliding comparison of a sample to its two immediate neighbors is performed, involving two operations only each time, with a limited number of comparisons between the potential peak candidates within an interval n/2. Compared to the theory presented previously, the resulting number of operations is dramatically reduced, allowing a real time identification of the peaks resulting from an interval of confidence n.

An illustration of the fast algorithm using the same interval of confidence of 100 ms (involving 5 samples) is shown in FIGS. 26–41.

Figure 26:
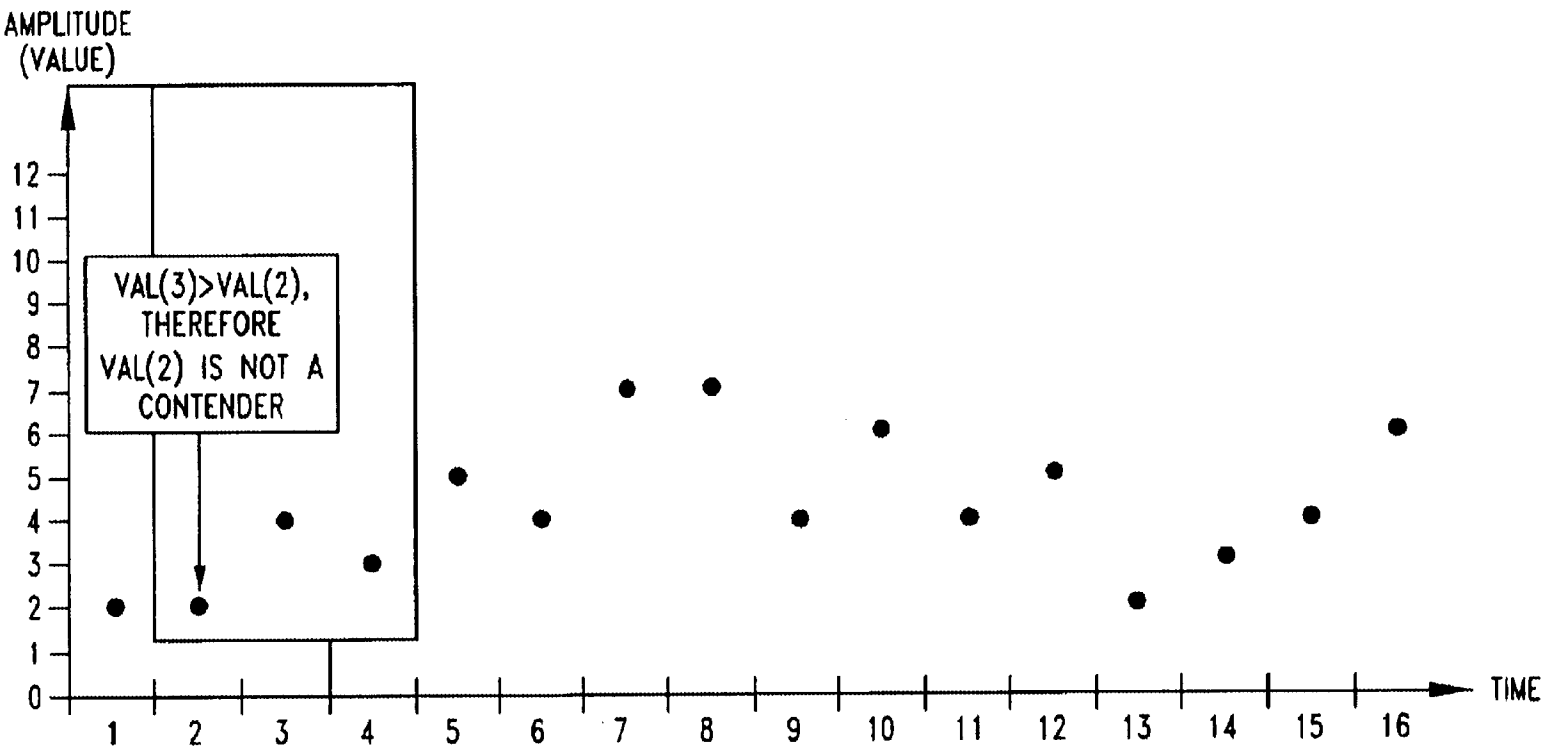
FIGS. 26–41 are plots of digital samples illustrating a second method of peak detection.
Figure 27:
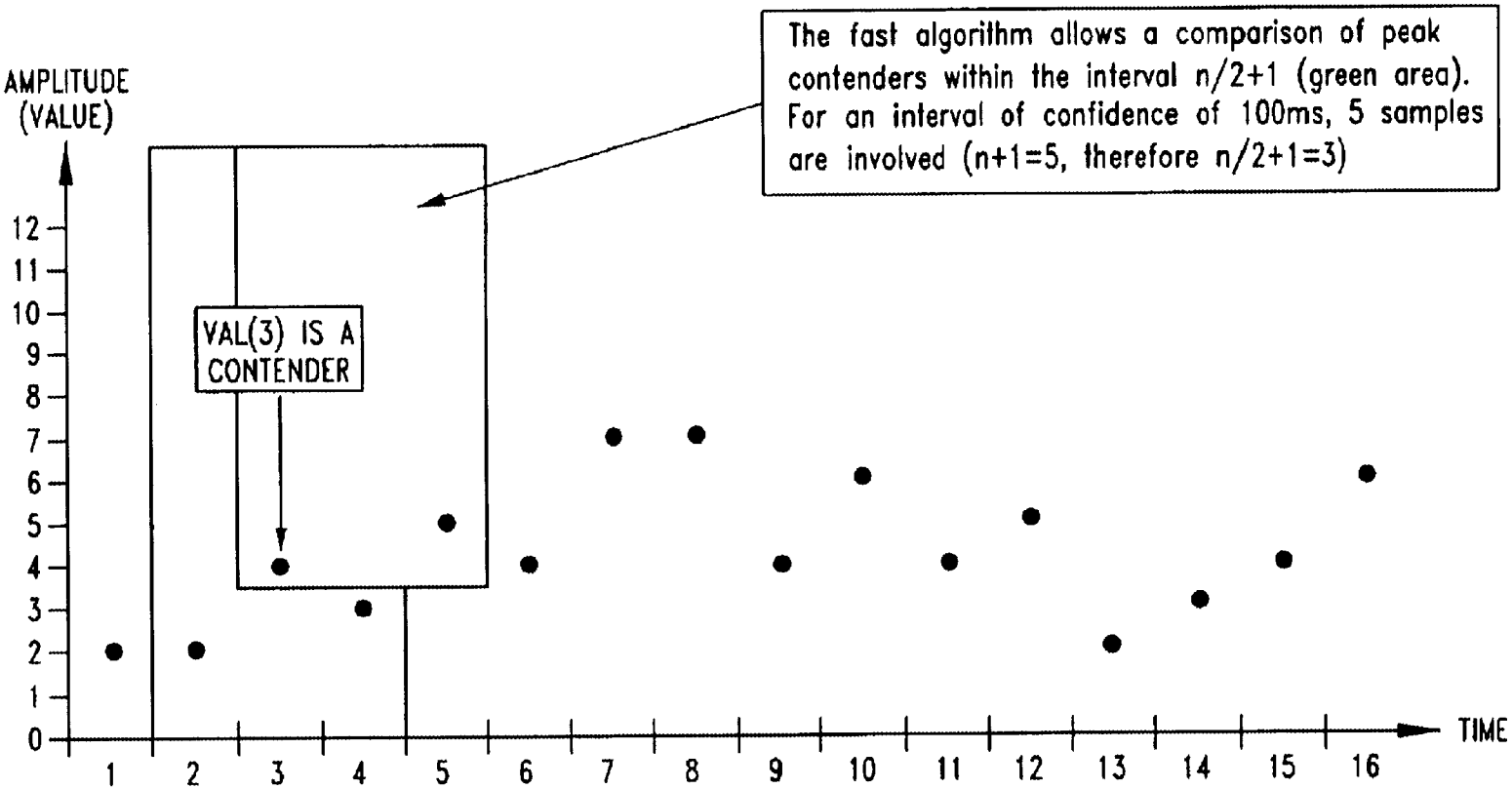
Figure 28:
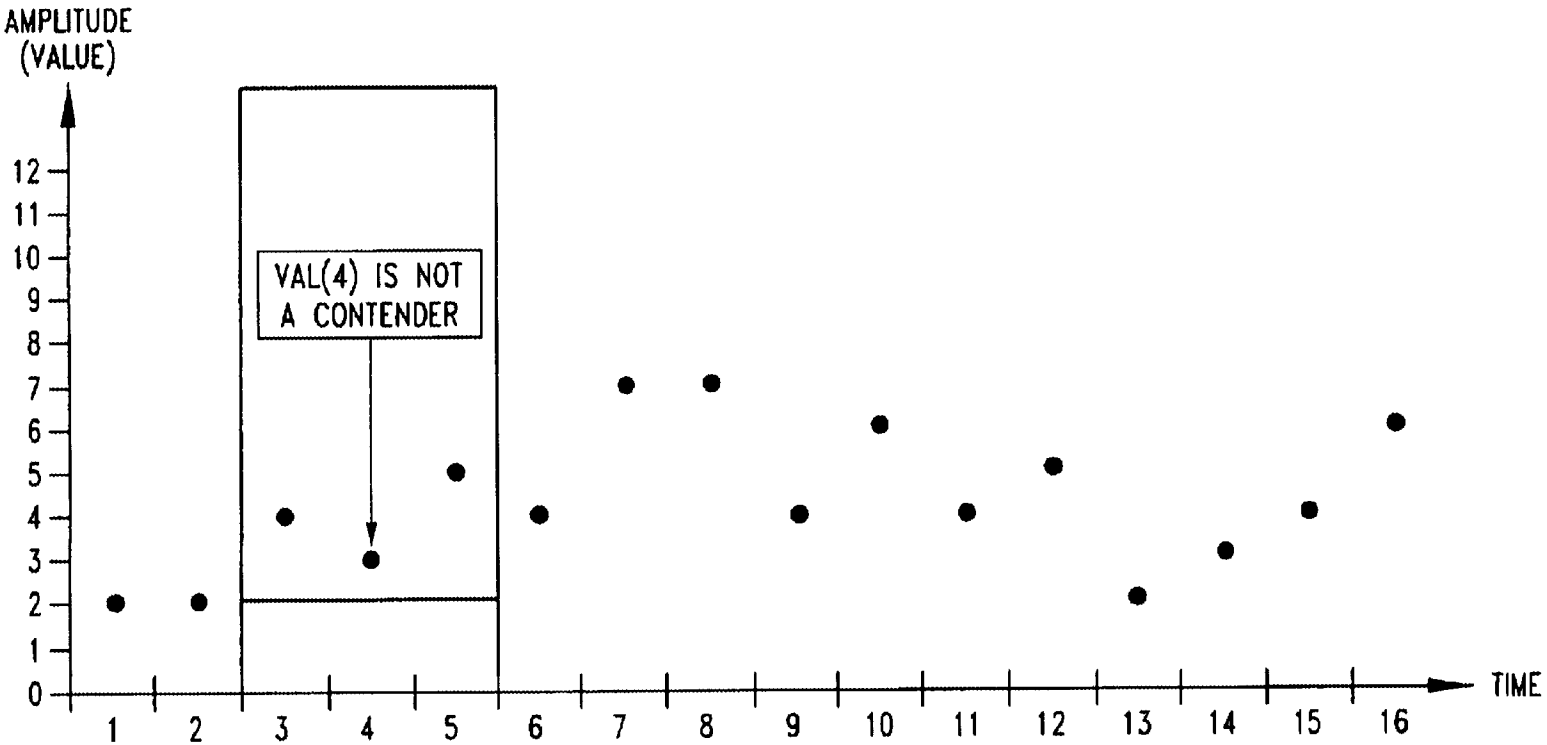
Figure 29:
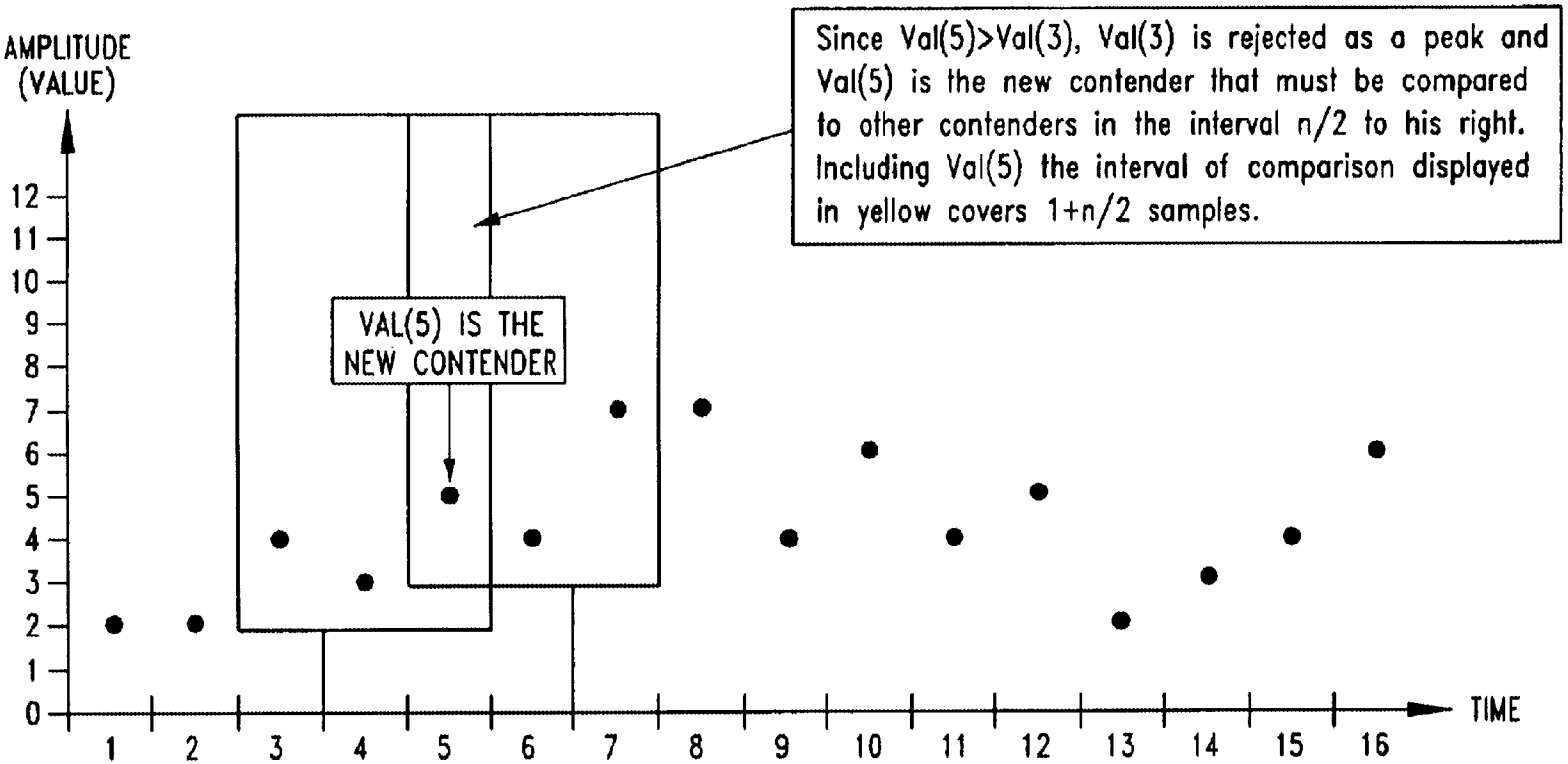
Figure 30:
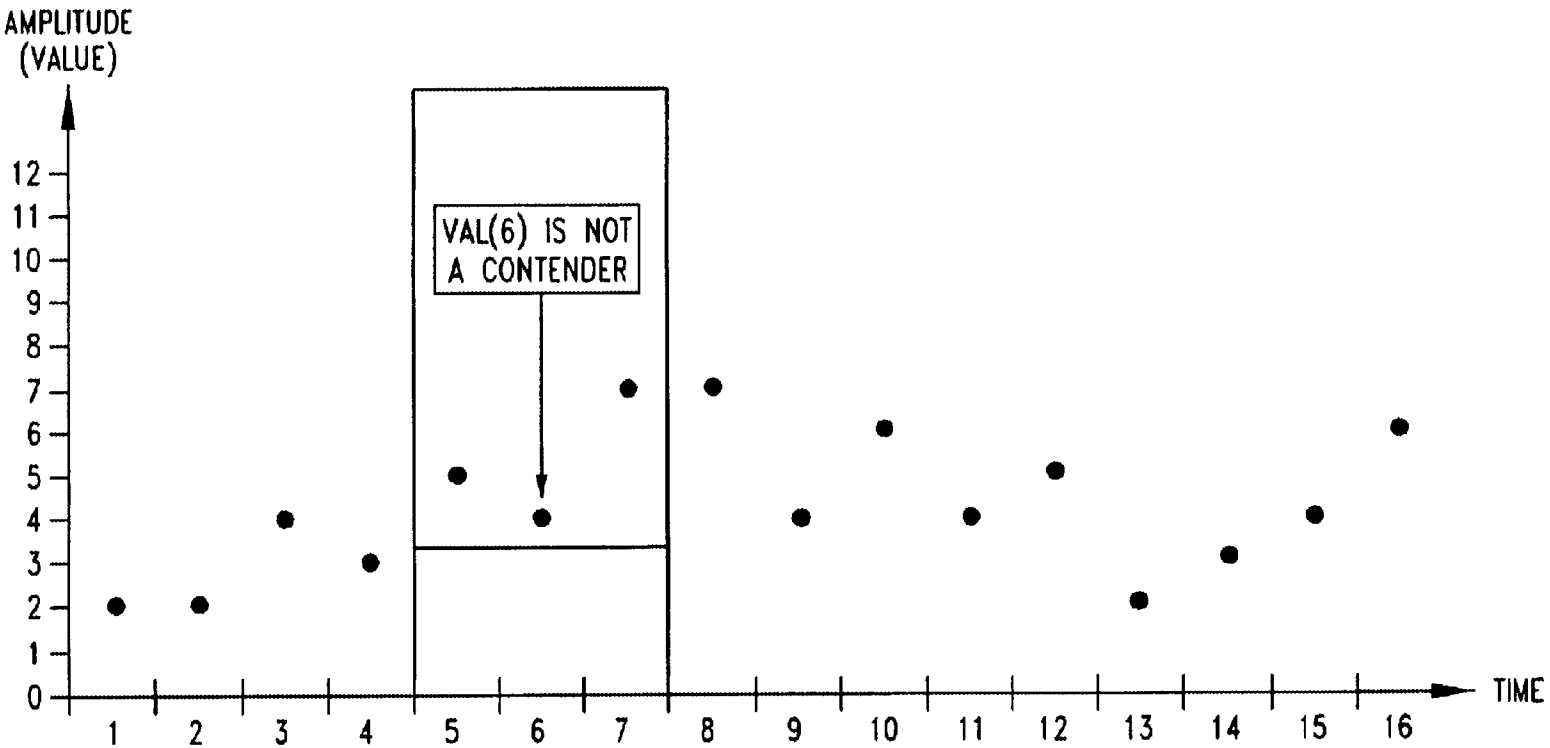
Figure 31:
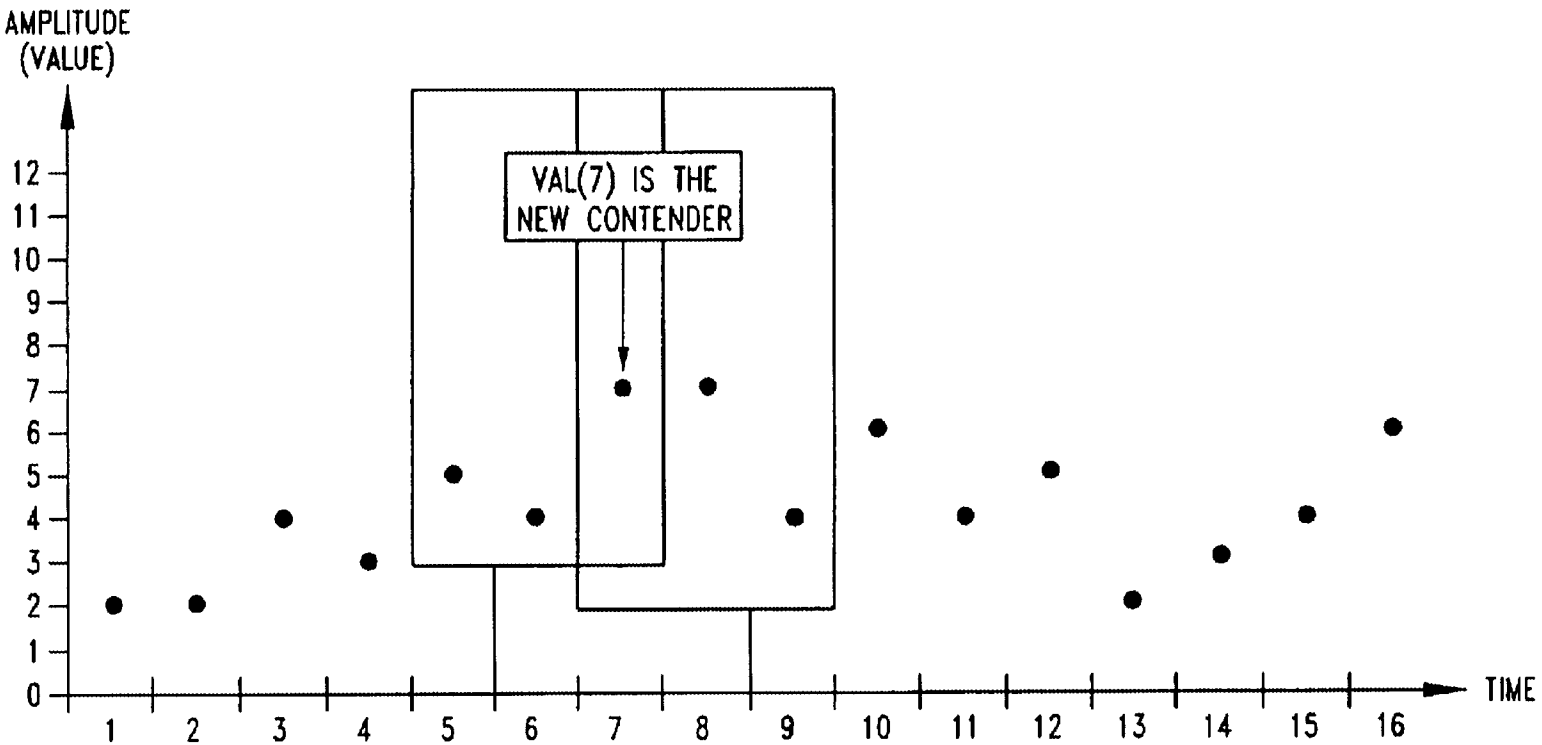
Figure 32:
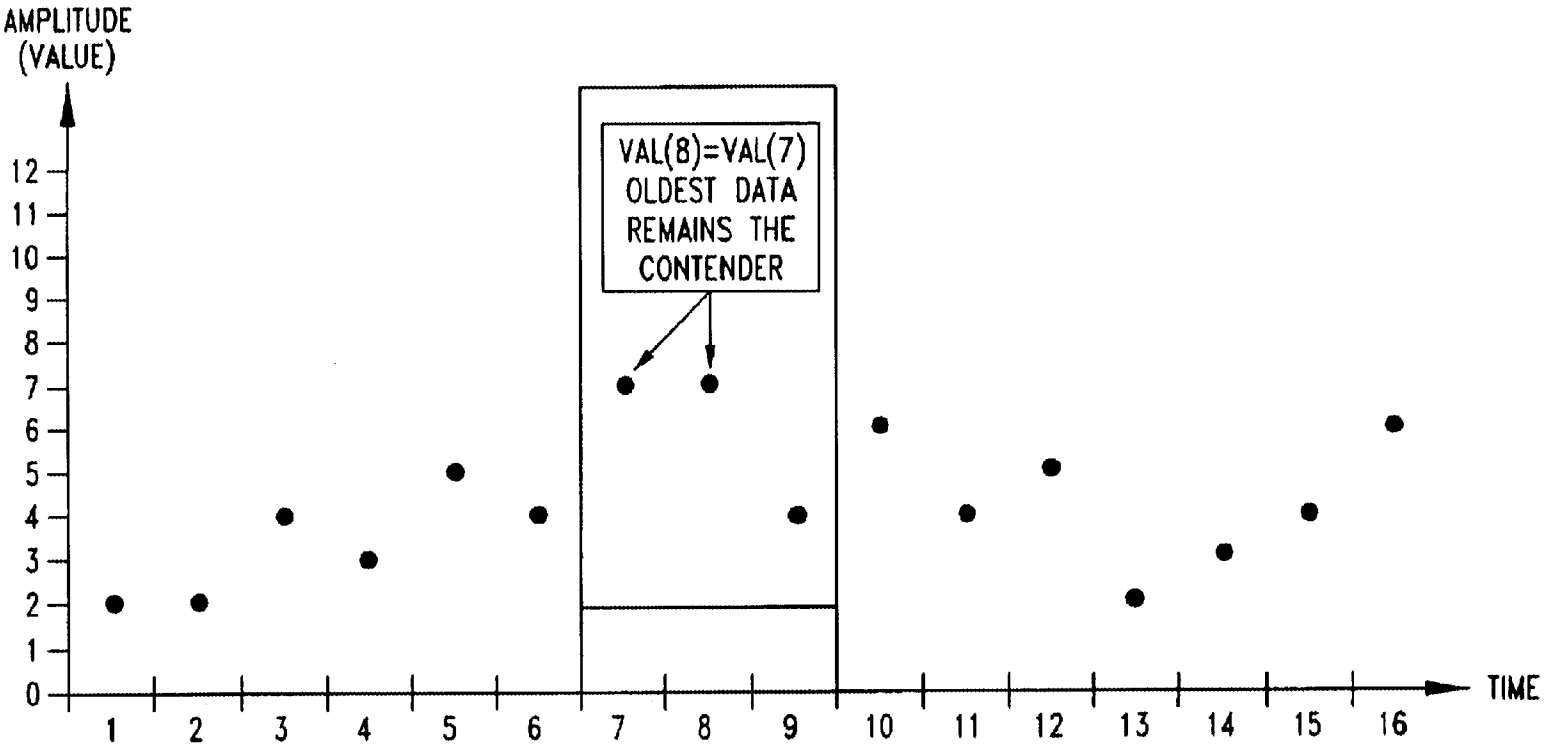

In FIG. 26, the second digital sample is compared to its immediate neighbors to the left and to the right. The fast algorithm performs a comparison of peak contenders within the interval n/2+1. For an interval of confidence of 100 ms, five samples are involved (n+1=5, therefore n/2+1=3). In FIG. 29, since Val(5) is greater than Val(3), Val(3) is rejected as a peak and Val(5) is the new contender that must be compared to the other contenders in the interval n/2 to its right. Including Val(5) the interval of the comparison displayed in the boxed area that encompasses Val(5) covers 1+n/2 samples.

Figure 33:
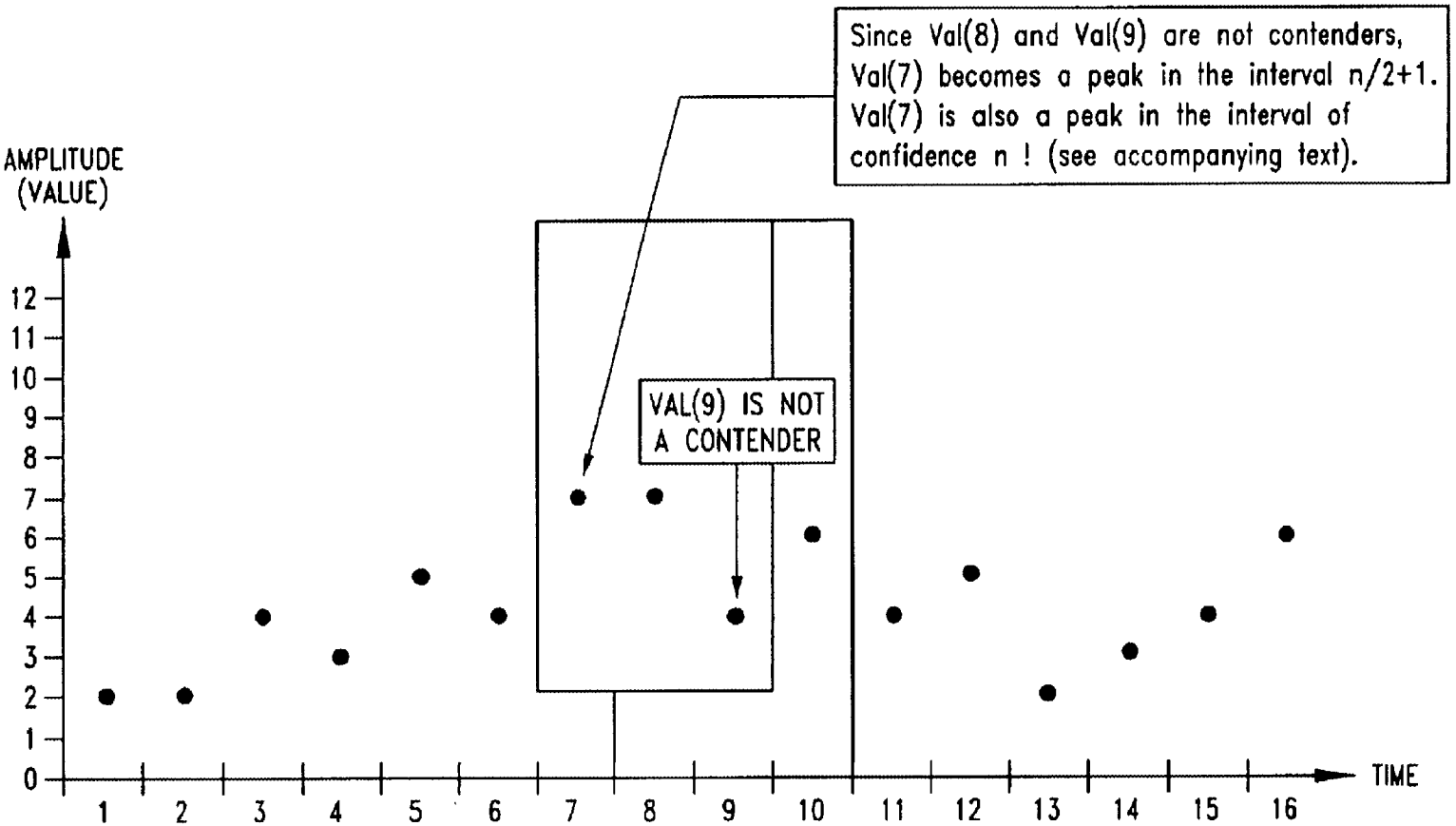
Figure 34:
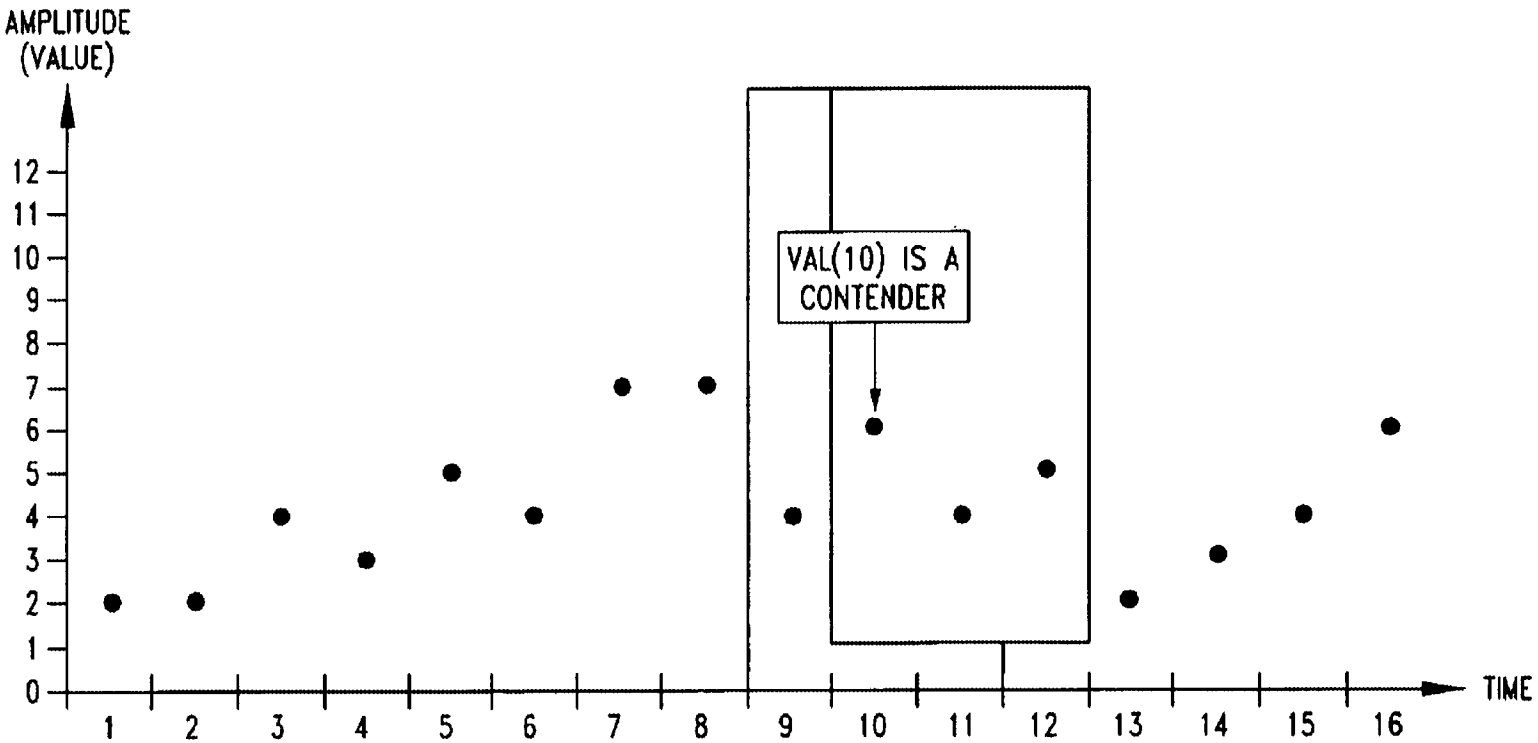
Figure 35:
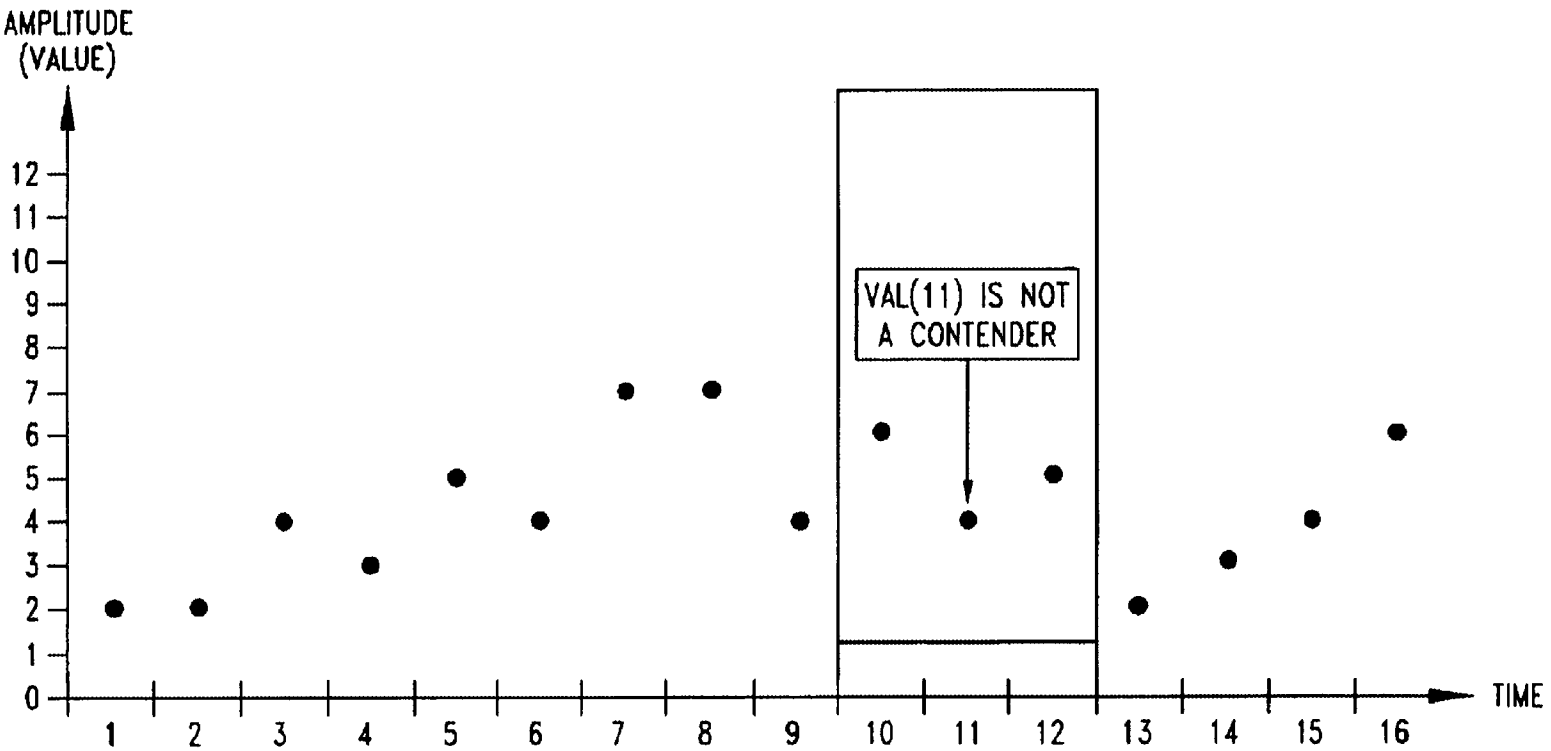
Figure 36:
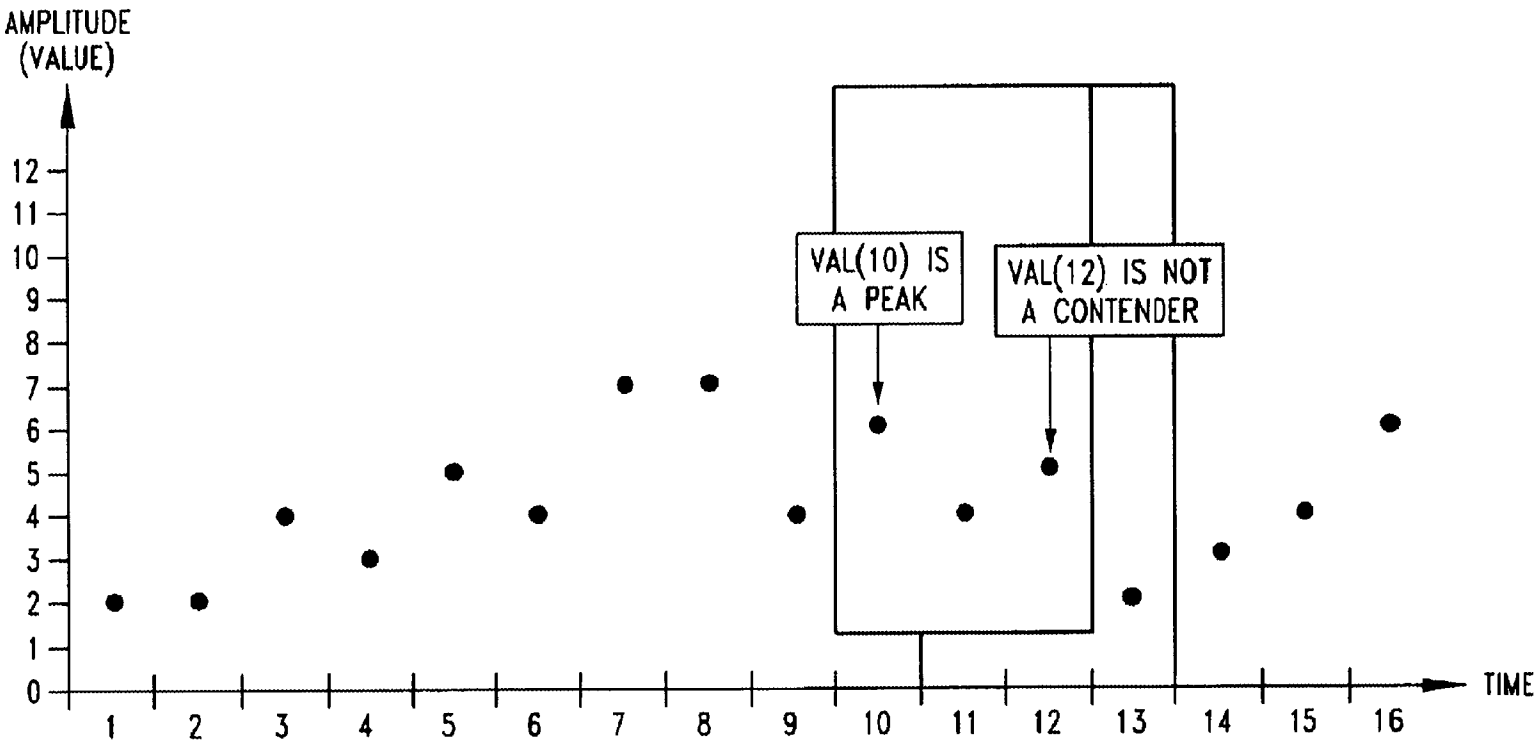
Figure 37:
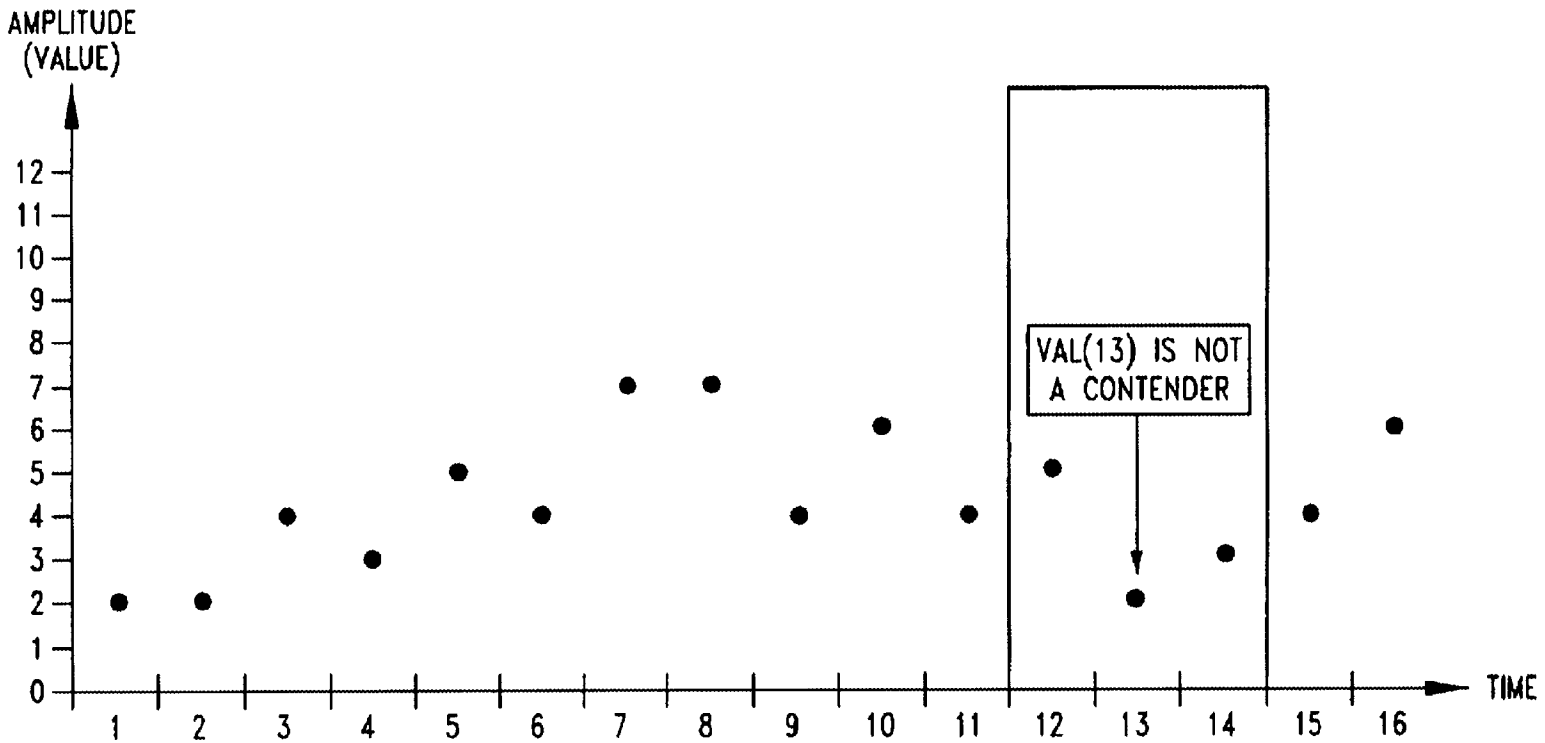
Figure 38:
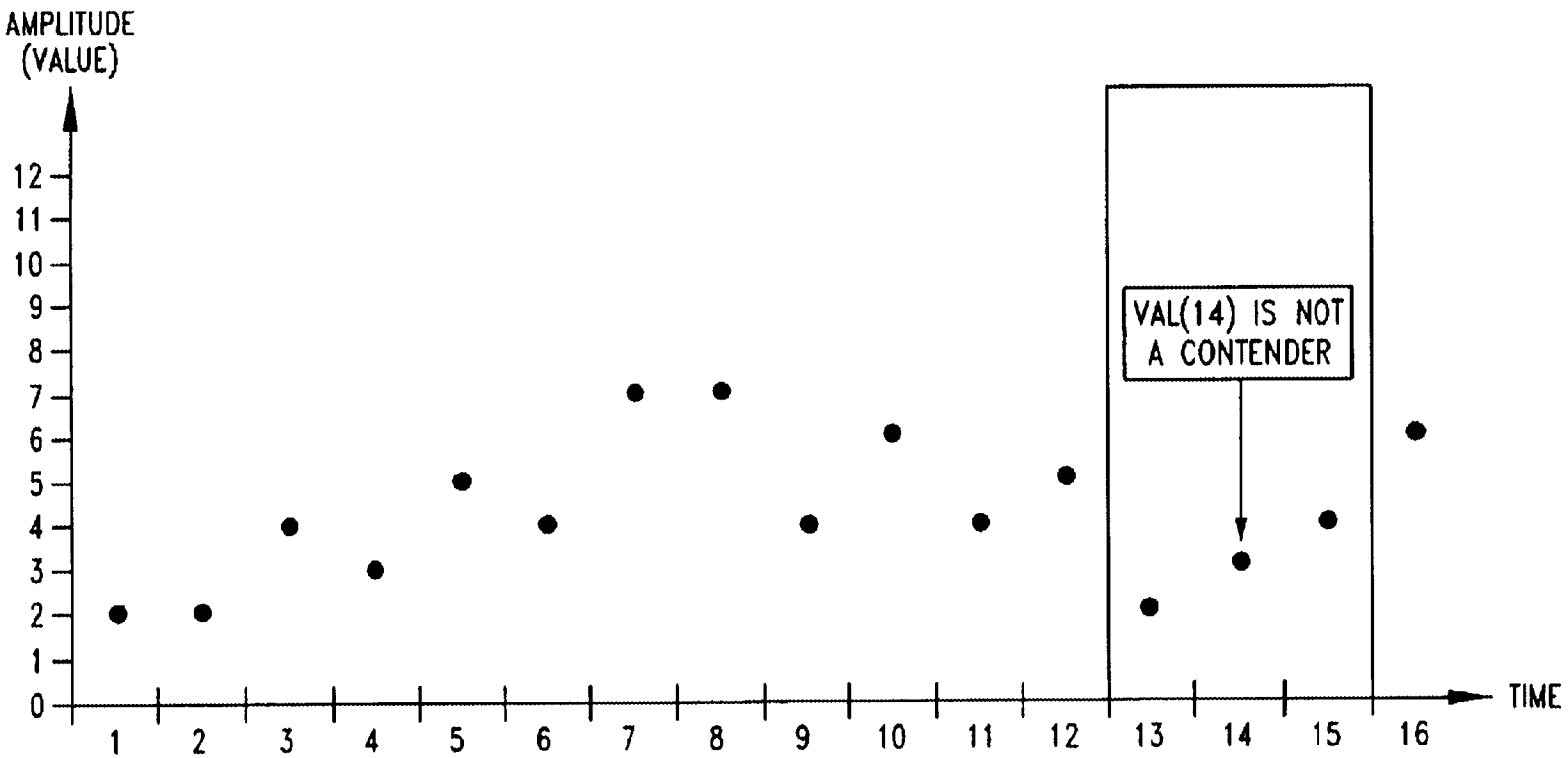
Figure 39:
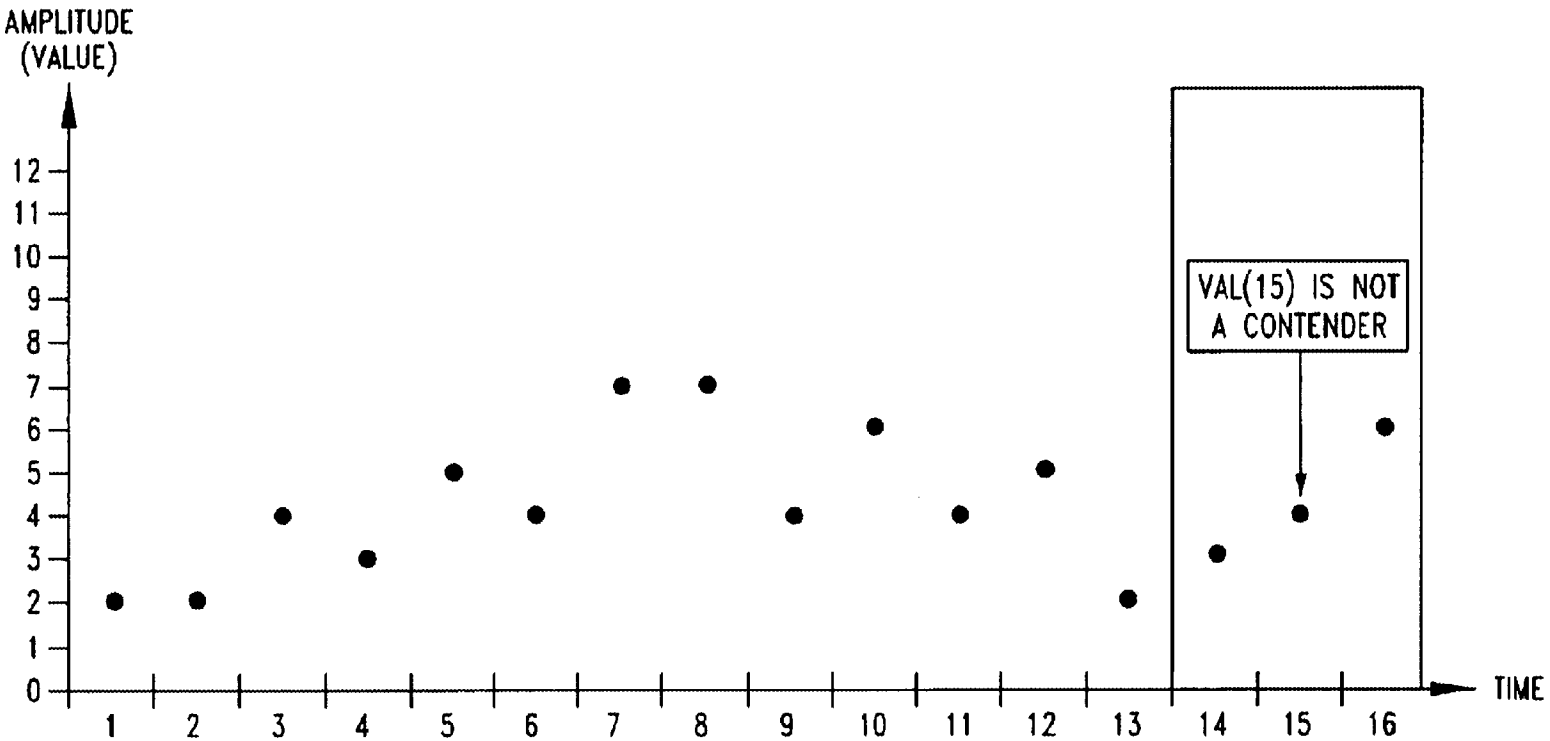
Figure 40:
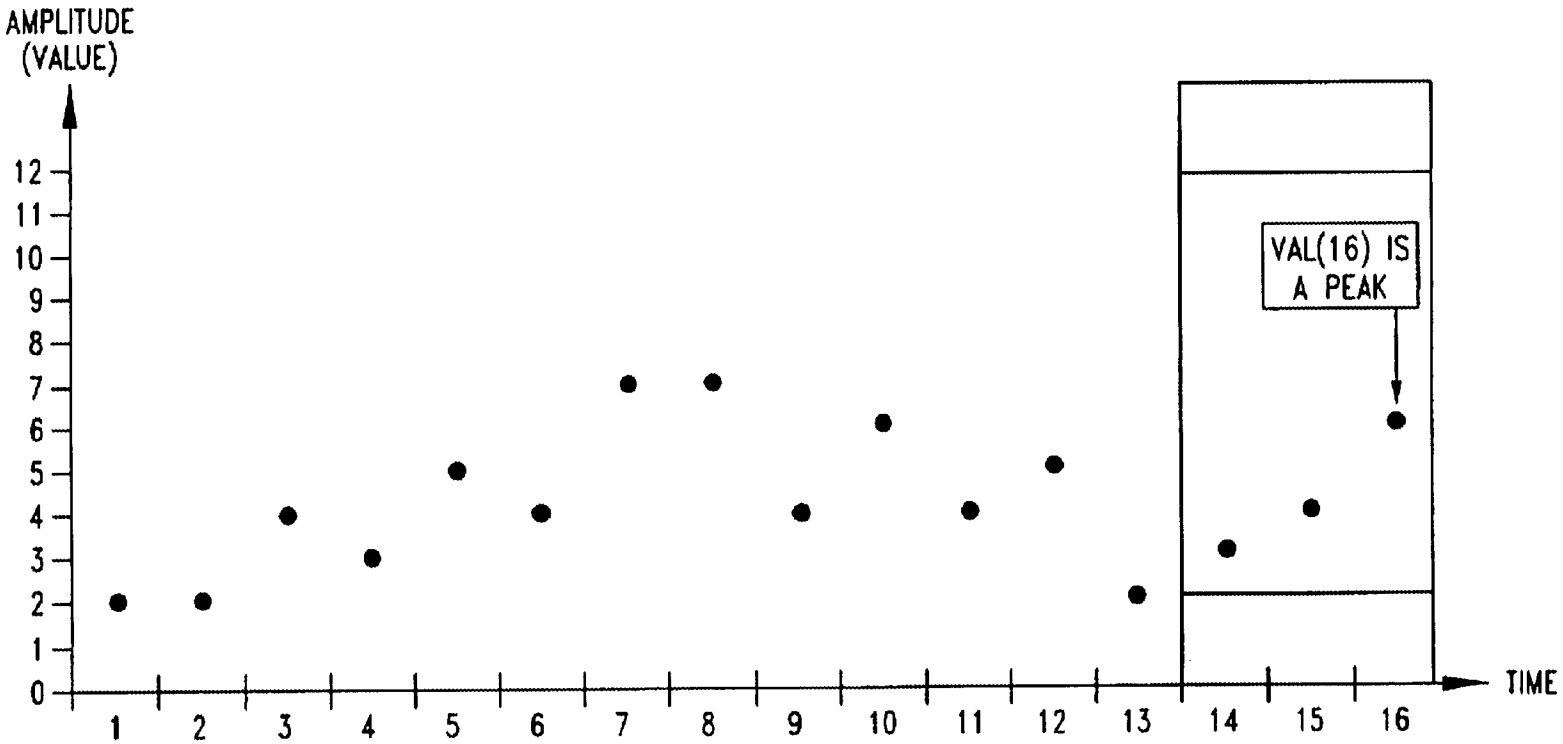
Figure 41:
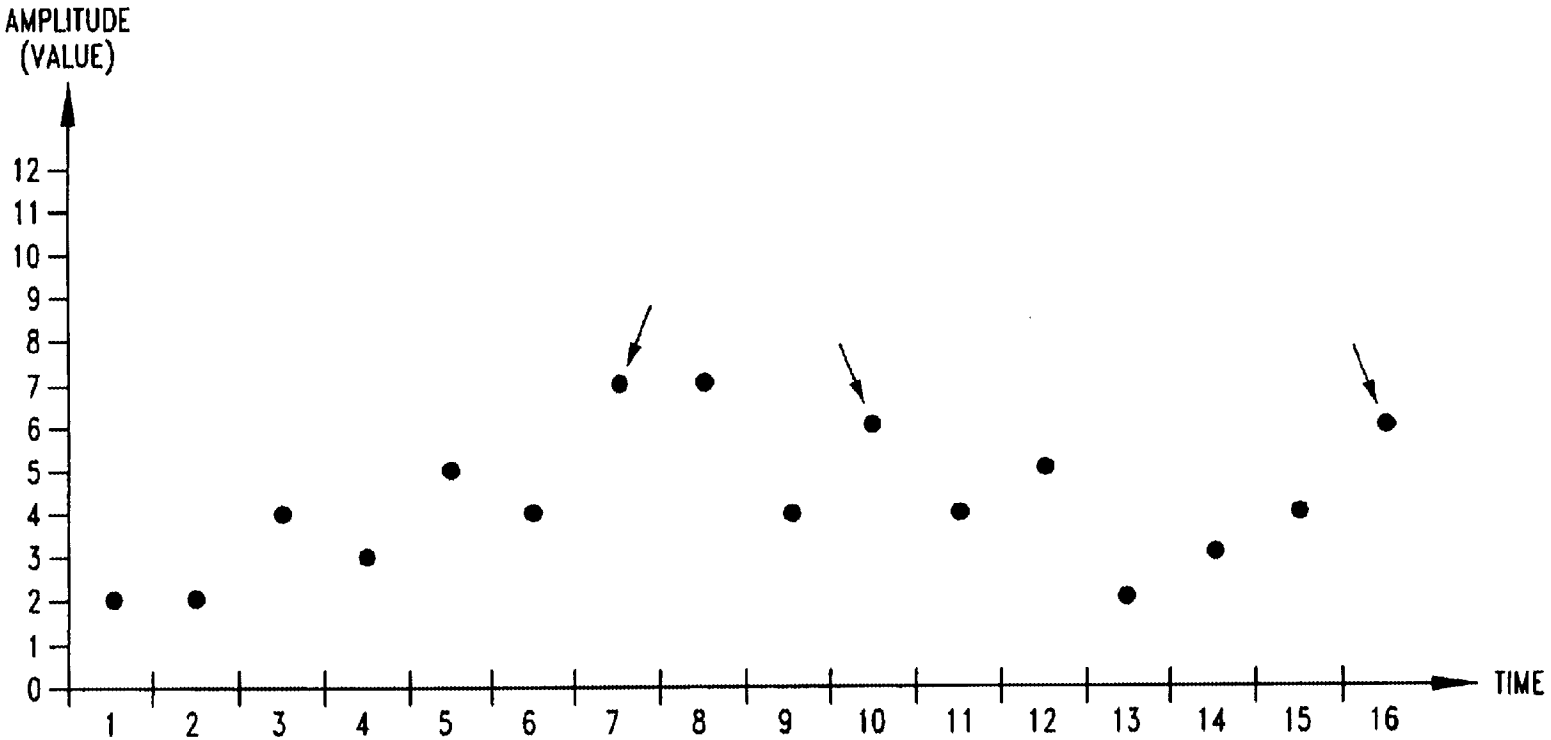
Figure 42:
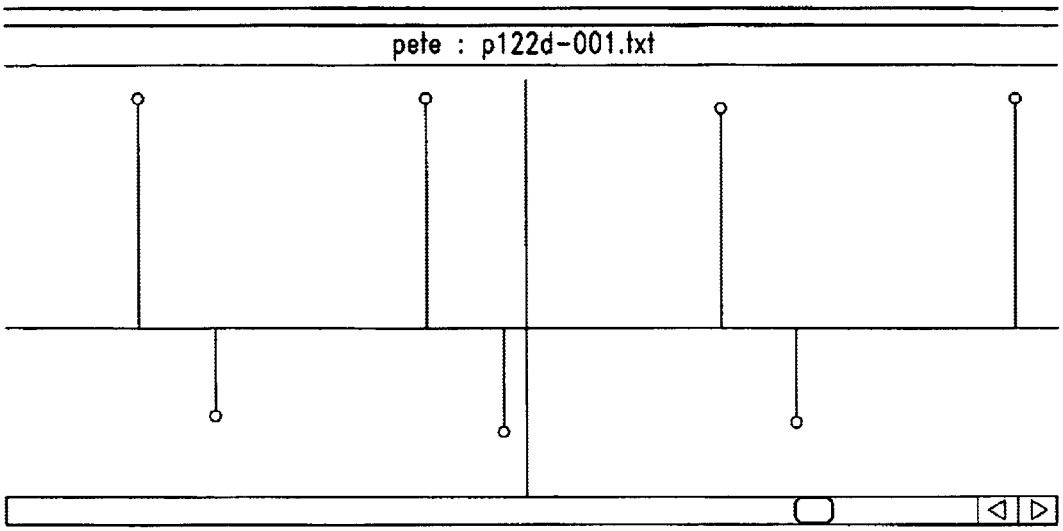
FIGS. 42–45 are plots of the performance of two swimmers showing peak detection of the second method of the present invention.
Figure 43:
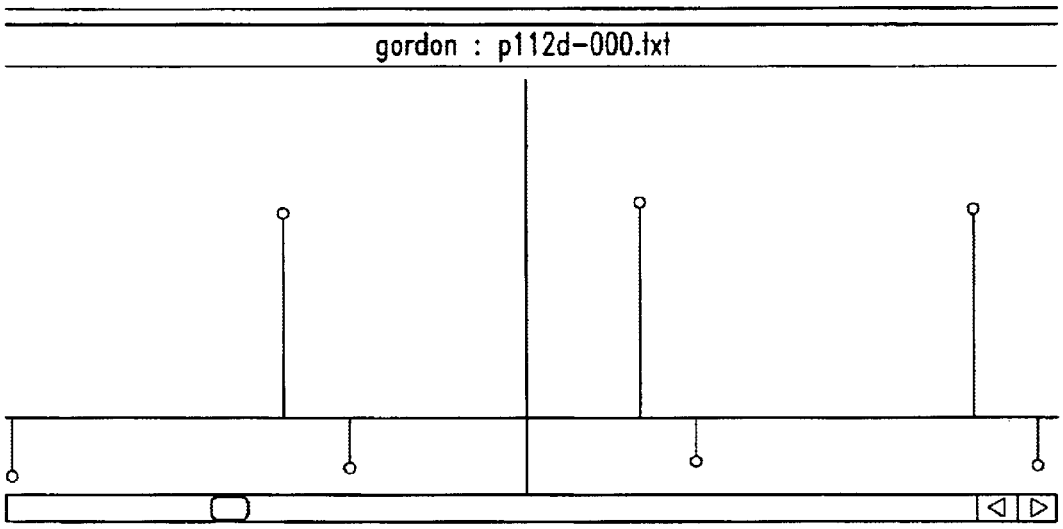
Figure 44:
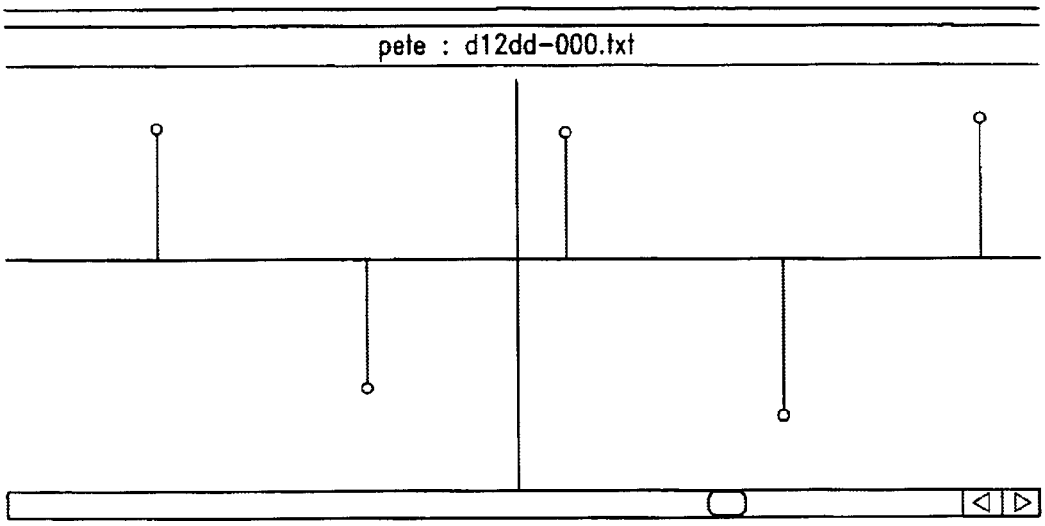
Figure 45:
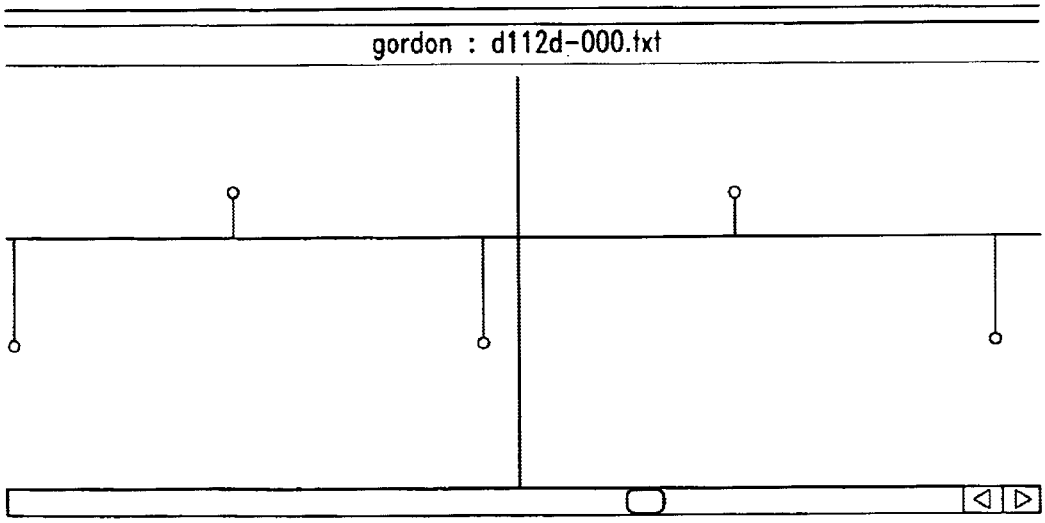

In FIG. 33, Since Val(8) and Val(9) are not contenders, Val(7) becomes a peak in the interval n/2+1. Val(7) is also a peak in the interval of confidence n.

When comparing the results of the first algorithm (FIGS. 21–25) to the ones of the fast algorithm (FIGS. 26–41) it can be seen that the second peak is not the same. The issue of detecting two peaks when two values of same amplitude fall within the interval of confidence was raised in the case of the first algorithm. This is no longer the case with the fast algorithm.

Also, the signal chosen to illustrate the peak detection algorithms is closer to background noise than a periodic signal. This explains the detection of the second peak using the fast algorithm, because of the choice of an interval of confidence of 5 samples (2 on each side of the sample being evaluated as a possible peak), for the purpose of the example. If two peaks fall within the interval of confidence, the algorithm will detect only one. Conversely, if a signal is expected to have a frequency of F Hz and the interval of confidence is determined accordingly, but over time the frequency of that signal drops to less than F/2 Hz, then the algorithm will detect additional peaks other than the peaks for each period.

In the example illustrating the fast algorithm, if the interval of confidence had been extended to 7 samples, for example (3 on each side of the sample being evaluated as a possible peak), the second peak would have never been detected and only Val(7) and Val (16) would have been detected as peaks.

It should also be noted that when two samples of equal amplitude fall within the interval of confidence (ex: Val(7) and Val(8) see FIG. 32) it was decided to retain the oldest sample as the unique peak (it could, have been decided to retain the most recent data).

FIGS. 42–45 are illustrations of the results provided by the algorithm for two swimmers, one a top swimmer, Pete, and the other one, a more ordinary swimmer, Gordon. Their respective stroke frequency was 0.7 Hz (1 stroke every 1.3 s) for Pete in the butterfly and 0.4 Hz (1 stroke every 2.5 s) for Gordon in the backstroke, but the interval of confidence was set to 2.4 s (1.2 s from each side of a sample) for both swimmers in the four strokes they swam. The algorithm never missed a peak.

The fast algorithm described above provided an automatic peak detection (maxima and minima) with 100% accuracy on all swimmers tested, when using an interval of confidence set around 2 s (1 s from each side of a sample to be tested as a peak). If necessary an optimal interval of confidence could even be automatically determined by the system by using an autocorrelation method from a few cycles of the signal, or a comparison of the results obtained with different intervals of confidence. This solution would cover a few extreme cases of swimmers showing huge variations of periodicity during their swim.

Compared to the first algorithm, the fast algorithm uses fewer number of CPU operations, which enables real time detection and identification of the peaks with minimal power processing power.

From the foregoing it will be appreciated that, although specific embodiments of the invention have been described herein for purposes of illustration, various modifications may be made without deviating from the spirit and scope of the invention. For example, an ECG module may be incorporated into the system to acquire and display the ECG of the swimmer in real time. The pulse will be taken from one temporal artery (right or left) by using a sensor, such as a piezoelectric sensor, and the output processed and displayed in the swimmer's field of view. Accordingly, the invention is not limited except as by the appended claims and the equivalents thereof.

What is claimed is:

1. A device for determining and displaying information about the repetitive movement of a swimmer's body, the device comprising:

a sensor assembly comprising at least two static acceleration sensors configured to be mounted to the swimmer's back and including a first acceleration sensor positioned to track movement of the swimmer's body about a first axis that is substantially parallel to a direction of travel of the swimmer's body and a second acceleration sensor positioned on the swimmer's body to detect movement about a second axis that is substantially perpendicular to the first axis, and to generate at least first and second static acceleration signals when the swimmer is swimming; and a processor coupled to the sensor assembly and configured to determine at least one from among a stroke identification, a stroke count, a stroke pattern, a lap count, and a breathing pattern in response to only the at least one static acceleration signal and to provide a signal for display.

2. A device for determining and displaying information about the repetitive movements of a swimmer's body, the device comprising:

a sensor assembly comprising a first static acceleration sensor and a second static acceleration sensor configured to be mounted to the swimmer's body to detect movement about a longitudinal axis of the swimmer's body and an axis perpendicular to the longitudinal axis, respectively, and to generate first and second static acceleration signals in response to movement of the swimmer's body when swimming; and a processor and display device coupled to the sensor assembly and configured to provide a real-time, continuous display of a stroke pattern of the swimmer's body in response to only the first and second static acceleration signals.

3. The device of claim 2 wherein the processor and display device are also configured to display the stroke pattern for each arm of the human body.

4. The device of claim 2 wherein the processor and display device are also configured to display the breathing pattern of the swimmer's body.

5. A device for determining and displaying information about the repetitive movements of a swimmer's body, the device comprising:

a sensor comprising a first accelerometer configured to be mounted to the swimmer's back and to detect movement about a first axis that is substantially parallel to a direction of travel of the swimmer's body and a second accelerometer configured to be mounted to the swimmer's body to detect movement that is substantially perpendicular to the first axis, the sensor configured to generate first and second static acceleration signals in response to movement of selected areas of the swimmer's body while swimming;

a processing circuit comprising a processor coupled to the sensor and configured to receive the first and second static acceleration signals and to determine the swimmer's stroke pattern and breathing pattern in response to only the first and second static acceleration signals; and a display device for providing a real-time, continuous visual display of the swimmer's stroke pattern, stroke count, and breathing pattern.

6. The device of claim 5 wherein the processor is configured to determine the swimmer's kick pattern, and the display device is configured to display the swimmer's kick pattern, the kick pattern comprising at least one kick count.

7. The device of claim 5 wherein the accelerometer is positioned to detect the angle of the first axis that is substantially parallel to the direction of travel of the swimmer's body and the angle of the second axis, which is substantially perpendicular to the first axis, with respect to a vertical axis.

8. The device of claim 5 wherein the first and second axes are positioned parallel to the surface of the earth.

9. The device of claim 5 wherein the swimmer's stroke pattern comprises a stroke count, the starting of swimming, the stopping of swimming, and turns to reverse course.

10. A device for determining and communicating information about the repetitive movements of a swimmer's body, the device comprising:

a sensor assembly configured for mounting to the swimmer's back and comprising a first accelerometer positioned to detect rolling motion of the swimmer's body about a longitudinal axis of the swimmer's body that is substantially parallel to the direction of travel of the swimmer's body, and a second accelerometer that is positioned to detect tilting movement of the swimmer's body about an axis that is substantially perpendicular to the longitudinal axis, the sensor assembly configured to generate static acceleration signals in response to tilting and rolling movements of the swimmer's body;

a processor coupled to the sensor and configured to provide real-time, continuous signals identifying at least the swimmer's stroke type and the swimmer's stroke pattern in response to only the static acceleration signals;

means for transmitting the real-time, continuous signals from the processor; and a communication device configured to receive the real-time, continuous signals from the transmitting means and to communicate at least the swimmer's stroke type and stroke pattern.

11. The device of claim 10 wherein the transmitting means comprise at least one bus to convey data from the processor to the communication device.

12. The device of claim 10 wherein the transmitting means comprise a radio frequency transmitter for transmitting signals from the processor to the communication device.

13. The device of claim 10 wherein the communication device comprises an earpiece coupled to the processor via the transmitting means and configured to generate audible sounds corresponding to at least the swimmer's stroke type and stroke pattern.

14. The device of claim 10 wherein the transmitting means is configured to transmit signals from the sensor assembly to the processor.

15. A device for monitoring repetitive movement of a swimmer's body, comprising:

a sensor assembly comprising a first acceleration sensor configured to be mounted to the swimmer's body and to generate a first static acceleration signal corresponding to acceleration of the swimmer's back about a first axis that is substantially parallel to the direction of travel of the swimmer's body when swimming and a second acceleration sensor configured to be mounted to the swimmer's back to generate a second static acceleration signal corresponding to acceleration of the swimmer's body about a second axis that is substantially perpendicular to the first axis, respectively of the swimmer's body when swimming;

a processor configured to receive the first and second static acceleration signals and to determine at least a stroke type and a stroke pattern of the swimmer's body therefrom; and a display device coupled to the processor and configured to display at least the stroke type and the stroke pattern.

16. The device of claim 15 wherein the display device is configured to display real-time, continuous information regarding the stroke type and stroke pattern.

17. The device of claim 15 comprising an audio device coupled to the processor and configured to generate audible sounds corresponding to at least the stroke type and the stroke pattern.

18. The device of claim 15 wherein the stroke pattern comprises the breathing pattern of the human body.

19. The device of claim 15 wherein the stroke pattern comprises at least stroke count, starting of swimming, lap count stopping of swimming, and turning movements to change course.

20. A method for monitoring repetitive movement of a swimmer's body, the method comprising:

mounting a first sensor to the swimmer's back to detect and track movement of the swimmer's body about a first axis parallel to the direction of travel of the swimmer's body and mounting a second sensor to the swimmer's back to detect and track movement of the swimmer's body about a second axis that is perpendicular to the first axis, both with respect to a vertical axis, and generating first and second static acceleration signals therefrom, when the swimmer is swimming;

receiving and processing the first and second static acceleration signals to determine at least variations in the swimmer's stroke pattern and kicking pattern over time; and providing a real-time, continuous observable output of at least the variations in the stroke pattern and the kicking pattern.

21. The method of claim 20 further comprising receiving and processing the first and second static acceleration signals to determine the swimmer's breathing pattern and providing a real-time, continuous display of the swimmer's breathing pattern.

22. The method of claim 20 comprising providing an audible signal corresponding to the swimmer's stroke pattern.

23. The method of claim 20 wherein the swimmer's stroke pattern comprises at least one from among periodicity, stroke count, start and stop of stroke, and stroke elapsed time.

24. A system for detecting and communicating information about the repetitive movements of a swimmer's body, the system consisting of:

a first accelerometer configured to be mounted on the swimmer's back and positioned to detect rolling motion of the swimmer's body about a longitudinal axis of the swimmer's body that is parallel to the direction of travel of the swimmer's body, and a second accelerometer that is configured to be mounted on the swimmer's back and positioned to detect tilting movement of the swimmer's body about an axis that is perpendicular to the longitudinal axis, the first and second accelerometers configured to generate respective first and second continuous static acceleration signals in response to tilting and rolling movements of the swimmer's body;

a processor coupled to the first and second accelerometers and configured to provide real-time, continuous signals identifying at least the swimmer's stroke type and the swimmer's stroke pattern in response to only the first and second static acceleration signals;

a transmitter adapted to transmit the real-time, continuous signals from the processor; and a communication device configured to receive the real-time, continuous signals from the transmitting means and to communicate at least the swimmer's stroke type and stroke pattern.

25. A method for monitoring repetitive movement of a swimmer's body and generating stroke pattern information therefrom, the method consisting of:

mounting a first accelerometer and a second accelerometer to the swimmer's back and positioning the first accelerometer to detect and track movement of the swimmer's body about a first axis parallel to the direction of travel of the swimmer's body and positioning the second accelerometer to detect and track movement of the swimmer's body about a second axis that is perpendicular to the first axis, both with respect to a vertical axis, and each accelerometer generating respective first and second continuous static acceleration signals;

receiving and processing the first and second continuous static acceleration signals in a processor and display device that are configured to provide a real-time, continuous observable output of the swimmer's stroke pattern.

* * * * *